US005831528A

United States Patent [19]

Cecic et al.

[11] Patent Number: 5,831,528

[45] Date of Patent: Nov. 3, 1998

[54] DETECTION OF GLASS BREAKAGE

[75] Inventors: Dennis Cecic; Hartwell Fong, both of Scarborough, Canada

[73] Assignee: Digital Security Controls Ltd., Downsview, Canada

[21] Appl. No.: 700,493

[22] PCT Filed: Mar. 3, 1995

[86] PCT No.: PCT/CA95/00122

§ 371 Date: Aug. 30, 1996

§ 102(e) Date: Aug. 30, 1996

[87] PCT Pub. No.: WO95/24025

PCT Pub. Date: Sep. 8, 1995

[30] Foreign Application Priority Data

Mar. 4, 1994 [CA] Canada ..... 2117053

[51] Int. Cl.[6] ..... G08B 13/00

[52] U.S. Cl. ..... 340/550; 340/566; 340/544; 340/522; 340/541; 73/658

[58] Field of Search ..... 340/550, 566, 340/544, 522, 541; 73/658

[56] References Cited

U.S. PATENT DOCUMENTS

| | | | |
|---|---|---|---|
| 3,717,864 | 2/1973 | Cook et al. | 340/566 |
| 3,863,250 | 1/1975 | McCluskey, Jr. | 340/550 |
| 3,889,250 | 6/1975 | Solomon | 340/540 |
| 3,955,050 | 5/1976 | DiToro | 381/84 |
| 4,030,089 | 6/1977 | Wurfel | 340/550 |
| 4,054,867 | 10/1977 | Owens | 340/550 |
| 4,088,989 | 5/1978 | Solomon | 340/506 |
| 4,091,660 | 5/1978 | Yanagi | 73/658 |
| 4,134,109 | 1/1979 | McCormick et al. | 340/550 |
| 4,196,423 | 4/1980 | Carver et al. | 340/566 |
| 4,668,941 | 5/1987 | Davenport et al. | 340/550 |
| 4,837,558 | 6/1989 | Abel et al. | 340/550 |
| 4,845,464 | 7/1989 | Drori et al. | 340/429 |
| 4,853,677 | 8/1989 | Yarbrough et al. | 340/544 |
| 4,929,925 | 5/1990 | Bodine et al. | 340/426 |
| 5,117,220 | 5/1992 | Marino et al. | 340/550 |
| 5,192,931 | 3/1993 | Smith et al. | 340/550 |
| 5,229,748 | 7/1993 | Ehringer et al. | 340/566 |
| 5,341,122 | 8/1994 | Rickman | 340/515 |
| 5,376,919 | 12/1994 | Rickman | 340/544 |
| 5,414,409 | 5/1995 | Voosen et al. | 340/541 |
| 5,510,765 | 4/1996 | Madau | 340/541 |
| 5,510,767 | 4/1996 | Smith | 340/566 |

*Primary Examiner*—Jeffery Hofsass
*Assistant Examiner*—Benjamin C. Lee

[57] ABSTRACT

A glass shattering detector and method for detecting breaking glass take advantage of the characteristics of high frequency components of a glass shattering signal which can be statistically recognized. In contrast to most non-glass breaking transient events, the higher frequency components are wide-band and random and, based on theses characteristics, can be distinguished from many non-glass break event transient signals.

25 Claims, 24 Drawing Sheets

FIG.12A1
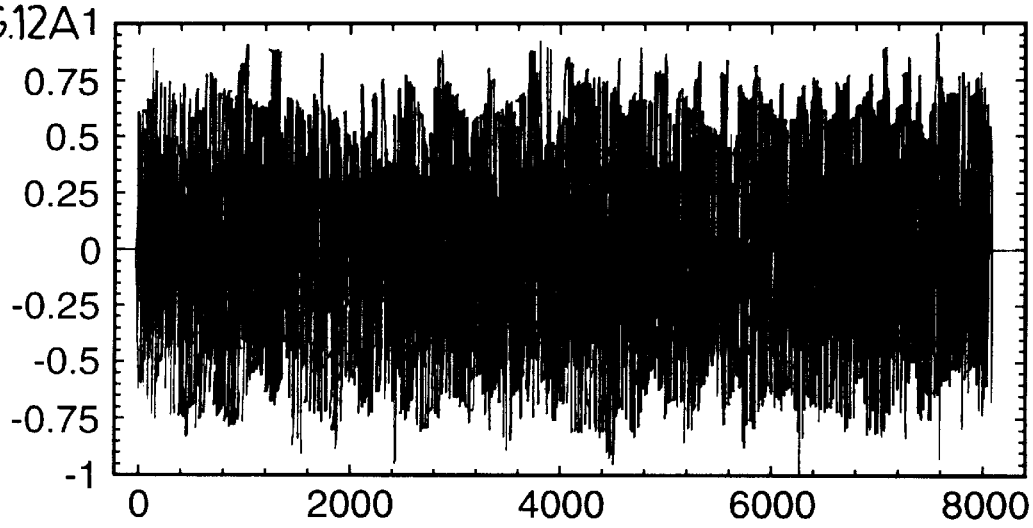
FIG.12B
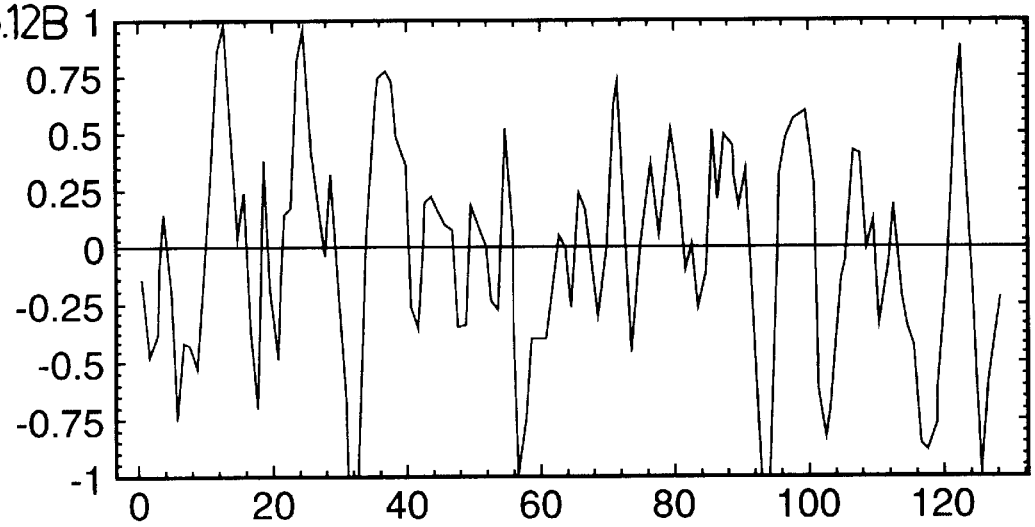
FIG.12C
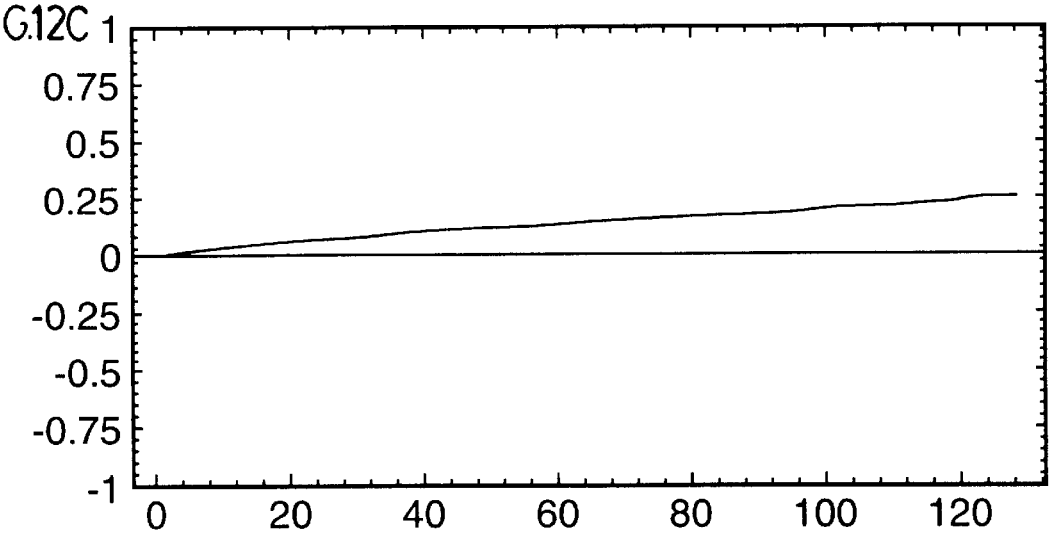

DETECTION OF GLASS BREAKAGE

FIELD OF THE INVENTION

The present invention relates to a glass break detector for detecting the shattering of glass as well as a method used by a glass break detector for detecting the shattering of glass.

BACKGROUND OF THE INVENTION

There are a number of existing glass break detectors, however, to date these detectors have not been entirely effective. The most significant problem to be solved by a glass break detector is the elimination of the occurrence of false alarms. Most of the prior art glass break detectors have recognized that there are low frequency components of a glass break signal. These low frequency components are often referred to as the "thud" associated with the initial force which leads to flexure of the glass and the subsequent shattering of the glass. The low frequency vibration of the glass and the subsequent low frequency vibration of the surrounding supporting structure, typically the glass frame, dominates these components. The prior art has also recognized that there are high frequency components between 4 kHz and approximately 8 kHz.

Some of the prior art systems have tried to categorize the glass break event by analyzing the amplitude and/or frequency of the signal. Some of these prior art structures have focused on a portion of the glass break signal at approximately 6.5 kHz while other systems have looked to timing relationships between the low frequency "thud" components and higher frequency components of a predetermined amplitude. The main problem with the prior art is the inability of the system to distinguish glass break events from non-glass break events. Common false alarms are caused by thunder, dropping metal objects, ringing of bells, service station bells, chirping birds, slamming doors, splintering wood and mouse traps. These sources have both low frequency components and high frequency components somewhat similar to a glass break event.

An improved alarm detection arrangement for detecting glass breakage is proposed herein which is more reliable and can more readily distinguish glass break events from many non-glass break events which previously caused false alarms.

SUMMARY OF THE INVENTION

A glass break detector according to the present invention detects the breaking of glass based on the non-deterministic characteristics of high frequency components of the signal and other characteristics which distinguish the signal from non-glass break transient events.

A glass break detector, according to an aspect of the present invention, detects the breaking of glass and comprises an acoustic transducer which is capable of producing a wide-band electrical signal, a processing arrangement for removing low frequency components and identifying changes in the electrical signal caused by a transient high amplitude non-deterministic signal, and an alarm arrangement which produces an alarm signal when a transient high amplitude non-deterministic signal is detected.

According to a preferred aspect of the invention, the processing arrangement of the glass break detector, includes an initial high-pass filter for eliminating low frequency components below about 1 kHz.

A glass break detector, according to the present invention, comprises an acoustical transducer responsive to acoustic pressure and, based thereon, produces an electrical output signal, a filter for removing low frequency components of the output electrical signal typically associated with the initial force leading to a glass break event and passing high frequency components of the output electrical signal, and a processing arrangement which uses statistical techniques for analyzing the high frequency components of the output signal for characteristics indicative of a glass break event and which collectively distinguish the output from non-glass break events, and producing an alarm signal when said characteristics are present.

According to a preferred aspect of the invention, the glass break detector includes a reference signal as part of the processing means which is cross-correlated with the higher frequency components of the output electrical signal for assessing whether the output electrical signal has characteristics indicative of a glass break event. The reference signal is representative of the higher frequency components of a glass break event and can be an actual glass break event or can be a fabricated approximation of a typical higher frequency components of a glass break event.

A glass break detector and a method of detecting glass breakage advantageously analyzes high frequency components of transient events recorded by an acoustic transducer. It has been found that when high frequency components, caused by a transient event, is wide-band and random in nature for a duration typical of a glass break event, a glass break event has been detected. The normal non-glass break transient events, which previously were a source of false alarms in prior art sensors, tend to be periodic or narrow band and as such can be distinguished, preferably statistically from an actual glass break event. Other techniques can be used in combination with the above to improve the reliability of the prediction.

A method of detecting the breaking of glass, according to the present invention, comprises sensing acoustical pressure and producing an electrical signal representative of the sensed acoustical pressure and identifying sudden changes in the signal caused by transient events. Statistical techniques are used for assessing the randomness of high frequency components of the signal resulting from the sudden changes and producing an alarm signal when a sudden change is detected and the high frequency components thereof can be statistically determined to be representative of a glass break event.

According to an aspect of the invention, the electrical signal is passed through a high-pass filter, which filters out frequencies less than about 1 kHz.

According to a further aspect of the invention, the method uses a cross-correlation statistical technique for comparing the the higher frequency components of the output signal with a reference glass break signal.

BRIEF DESCRIPTION OF THE DRAWINGS

Preferred embodiments of the invention are shown in the drawings, wherein:

FIG. 12 is a graph of the sample signal of FIG. 11, followed by a graph of the cross-correlation output, followed by the summation of the absolute value of the cross-correlation output;

DETAILED DESCRIPTION OF THE PREFERRED EMBODIMENTS

Figure 1:
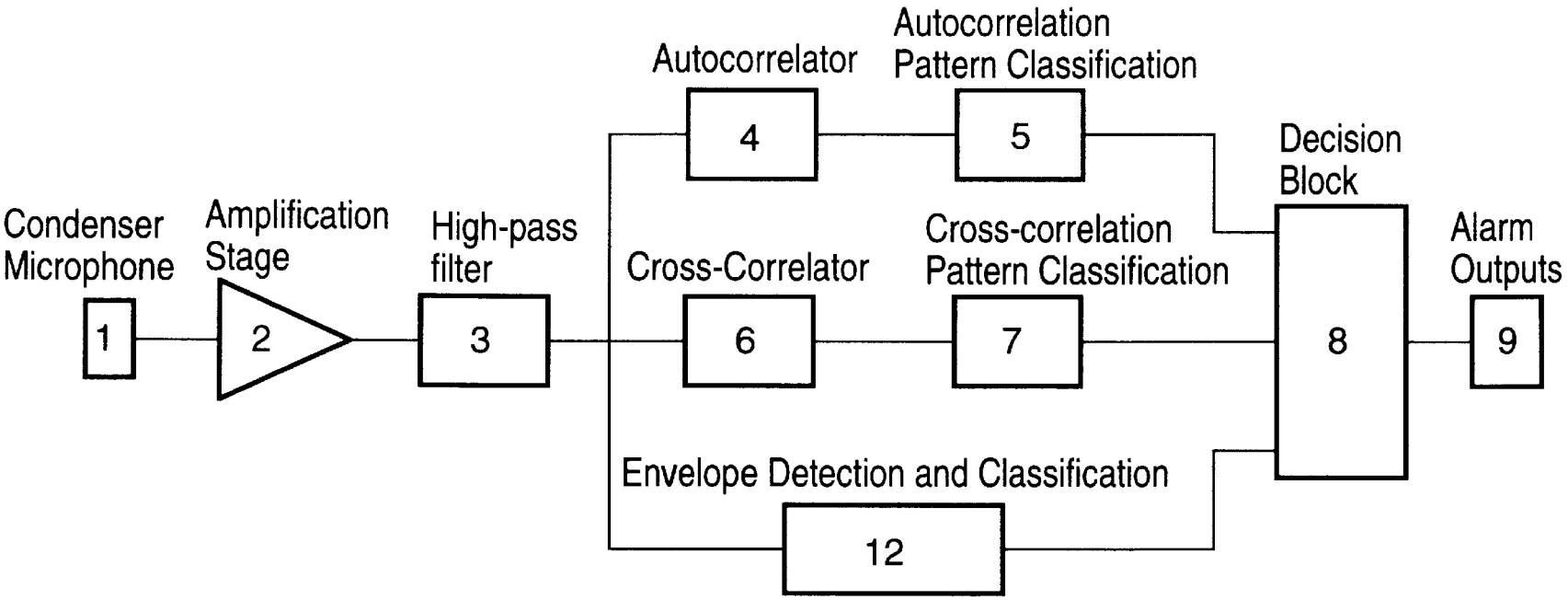
FIG. 1 is a block diagram of the glass break detector.

A glass break event, when detected by a microphone, produces a sudden change in the output electrical signal. The output electrical signal has low frequency components generally below 1 kHz, and higher frequency components thereabove. The higher frequency components are well represented in the range of 1 kHz to 12 kHz (12 kHz is typical about the upper limit of a microphone). The low frequency components includes the sounds produced by vibration of the window frame and the surrounding structure when a glass break event occurs. The higher frequency components, generally between 1 kHz and 12 kHz, are generally indicative of the sound produced by the shattering or fracturing of the glass. These higher frequency components have been found to be non-deterministic (wide-band or random) in nature (i.e. low periodicity) and the envelope of these components generally follows an exponential decay type function.

The present inventors have investigated the frequency distribution of the higher frequency components and have determined that these components are non-deterministic. The components are wide-band and do not repeat for different glass breaks, even if the same type and size of glass is used. Close inspection of the higher frequency components reveal that there is a high degree of randomness in the amplitude and there is only low periodicity of the high frequency components. Although the glass break event is quite unpredictable, this characteristic can be used to distinguish a glass break event from signals which commonly cause false alarms, such as dropping wrenches, bells, thunder, ringing phones, etc., which have relatively high periodicity throughout the signal and are more predictable.

The glass break event, particularly when the higher frequency components are analyzed alone, is highly random in nature and this characteristic of the signal is used to distinguish it from typical non-glass break transient event signals. In order to quantify the degree of randomness and periodicity in the input signal, statistical techniques are used and found to be highly efficient in distinguishing the higher frequency components from common non-glass break false alarm signals. By investigating the higher frequency components alone, improved analysis is possible, since the low frequency components are reduced and thus, the dynamic range available to the signal of interest is increased. Analysis established that the higher frequency components of a glass break event were very unpredictable, however, overall, the signal was wide-band, random and generally had a rapid rise followed by an exponential decay envelope.

It was also found that the low frequency components signal associated with the structural vibrations only tended to mask the differences between the higher frequency components and the typical sources of false alarms, and therefore, the entire system was improved by filtering out the low frequency components, leading to improved reliability of the statistical analysis.

Figure 2A:
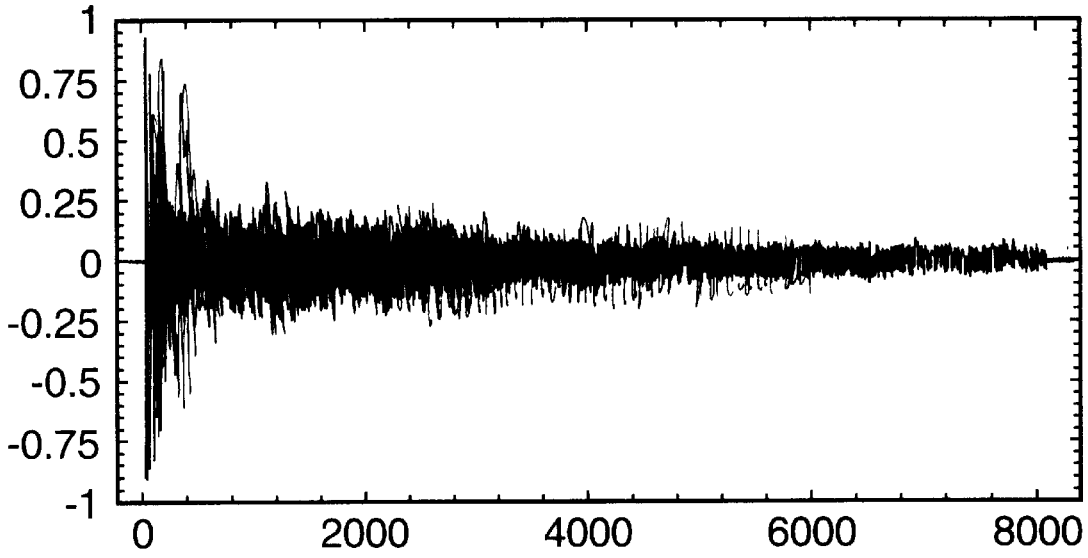
FIG. 2A shows a sample pattern representing a high pass filtered glass break event used as a reference signal in cross-correlation analysis to distinguish glass break events from other sounds.
Figure 2B:
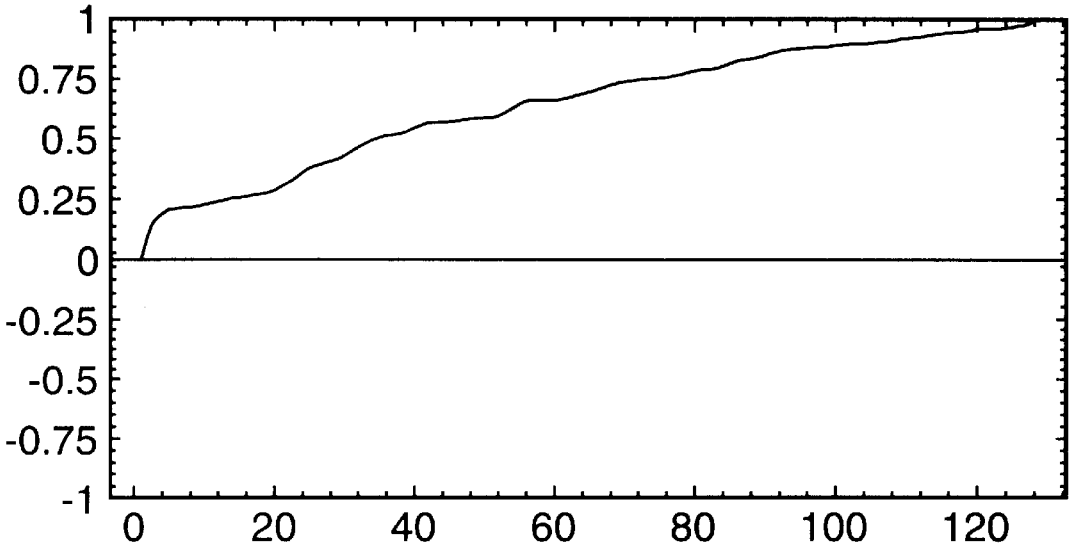
FIG. 2B is a plot of the summation of the absolute value of the cross-correlation output of the sample pattern to itself. This is the highest plot and other signals that may be caused by glass signal events can be compared therewith.
Figure 3A:
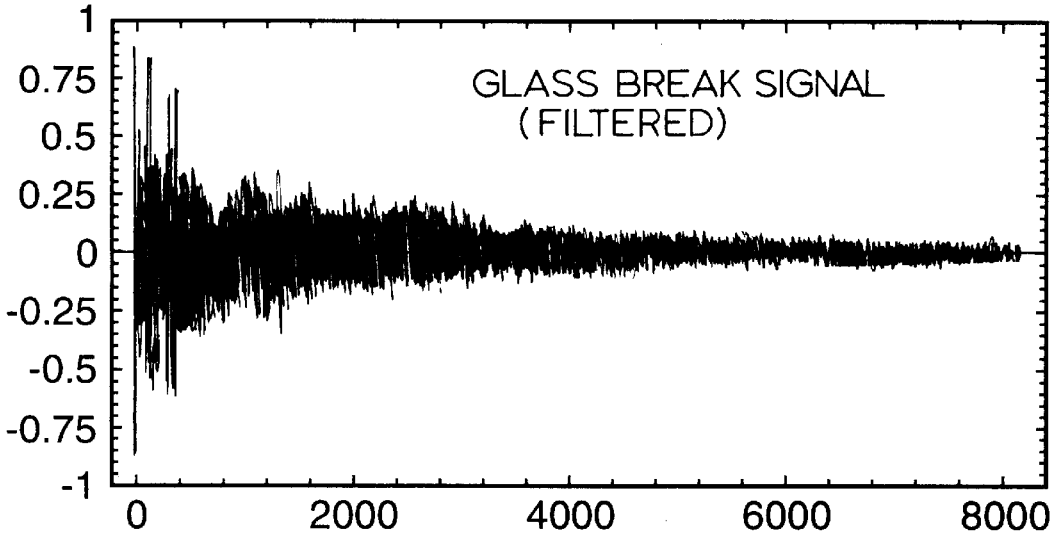
FIG. 3 shows the autocorrelation function (lower graph) when the input to that function is a filtered glass break event produced by breaking a 3 mm annealed glass sample 18"× 18" not broken in a frame (upper graph)
Figure 3B:
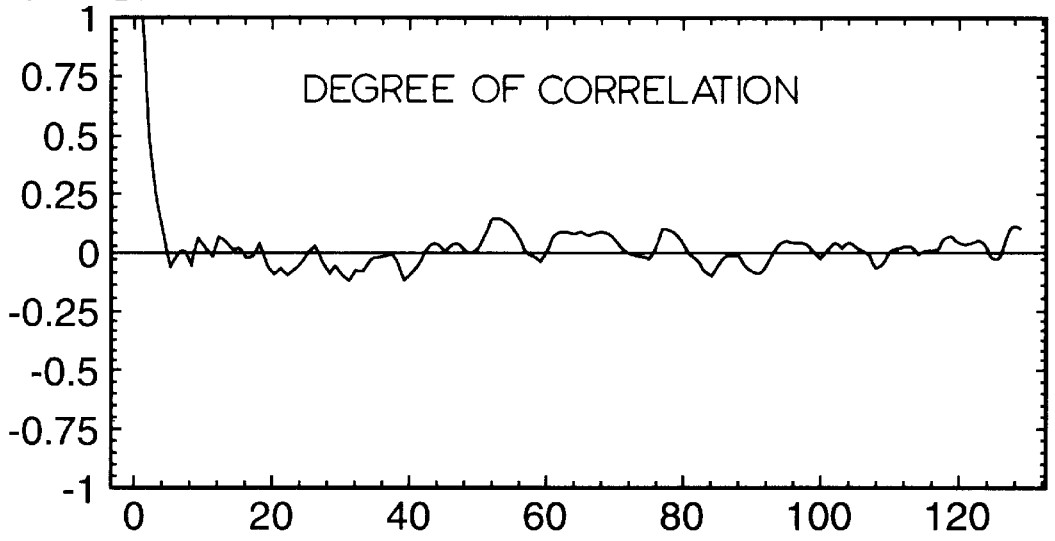
Figure 4A:
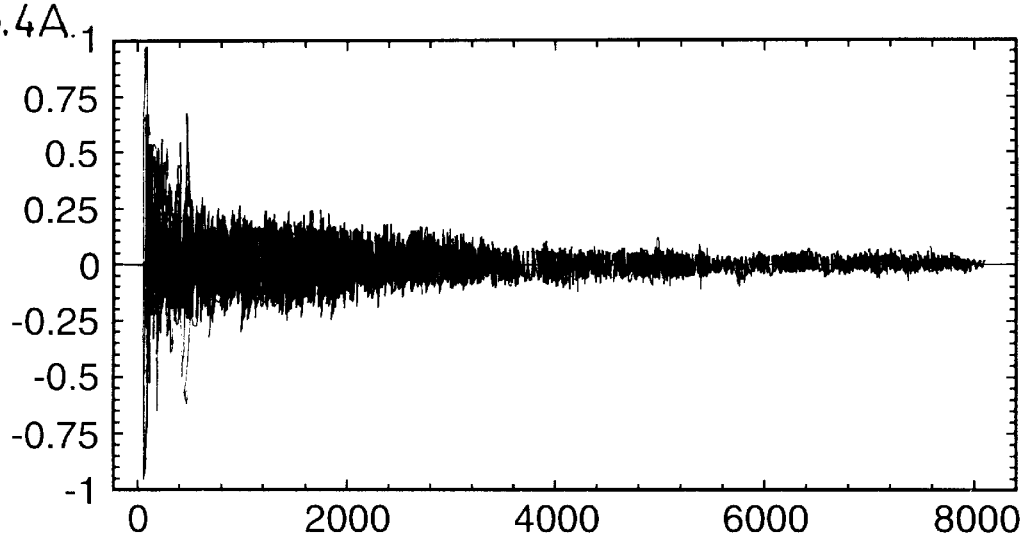
FIG. 4 is a graph of the sample signal of FIG. 3, followed by a graph of its cross-correlation output, then followed by the summation of the absolute value of the cross-correlation output.
Figure 4B:
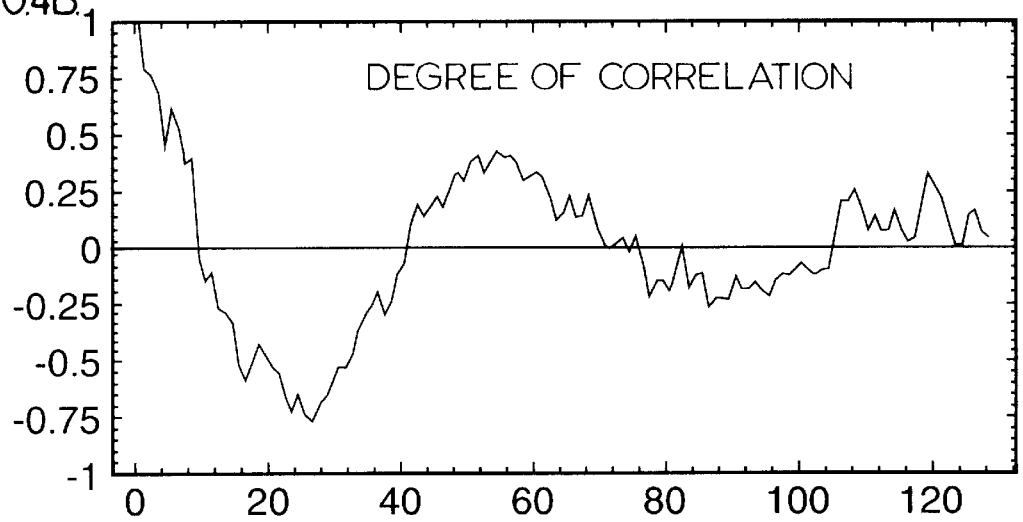
Figure 4C:
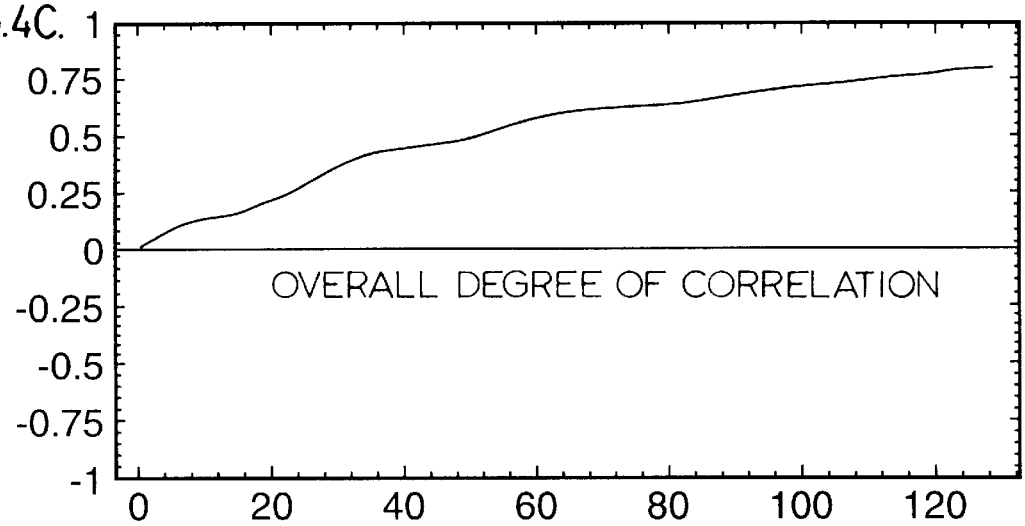
Figure 5A:
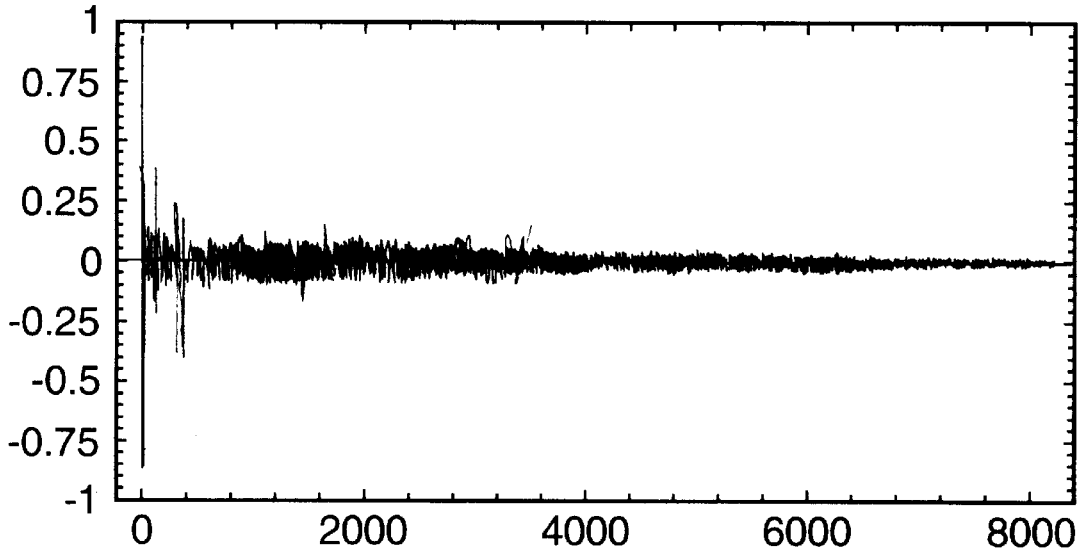
FIG. 5 is a graph of a filtered glass break signal representative of breaking 4 mm tempered glass 18"× 18" not broken in a frame, followed by a graph of the output of the autocorrelation function for this sample.
Figure 5B:
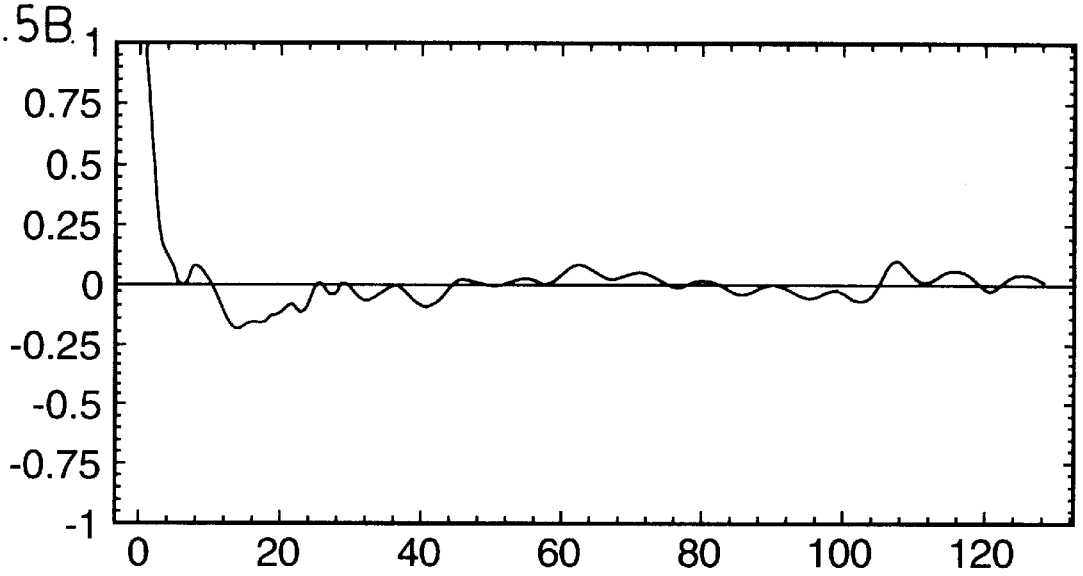
Figure 6A:
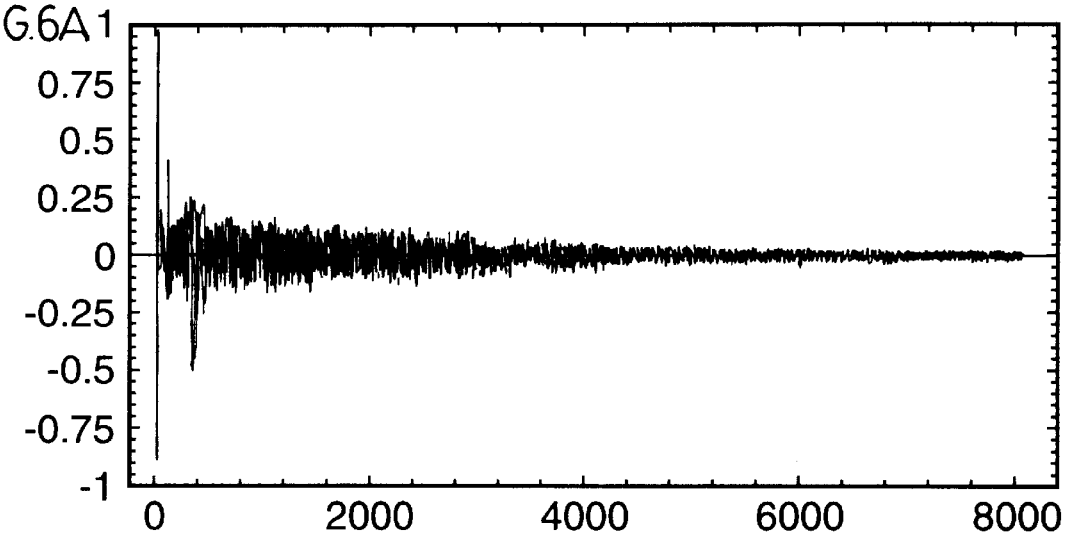
FIG. 6 is a graph of the sample signal of FIG. 5, followed by a graph of the cross-correlation output, followed by the summation of the absolute value of the cross-correlation output.
Figure 6B:
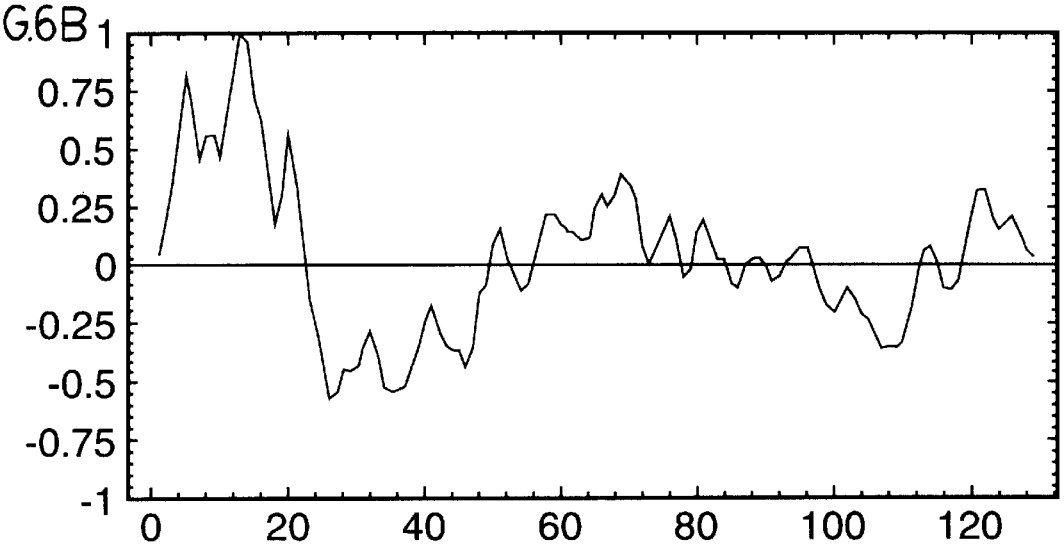
Figure 6C:
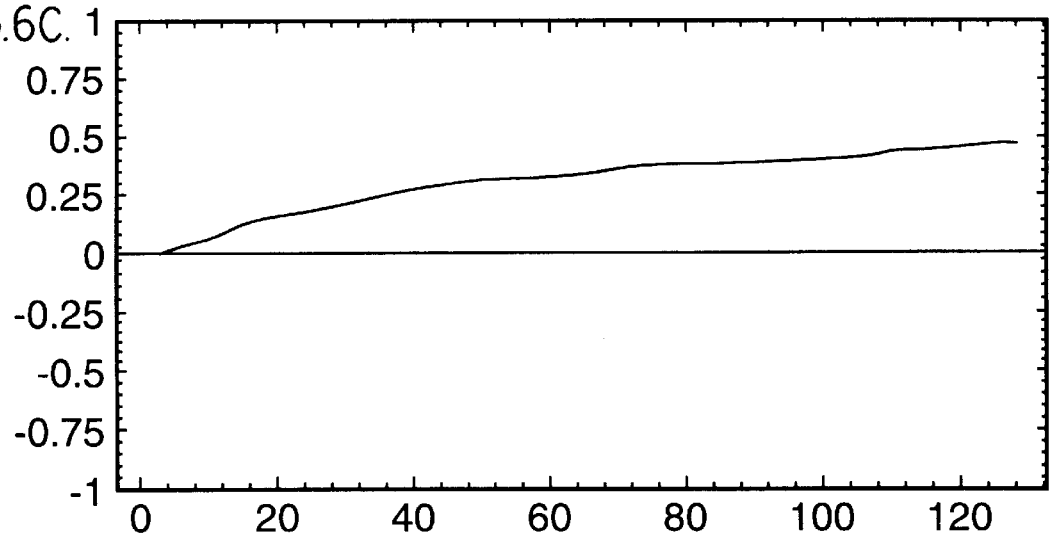
Figure 7A:
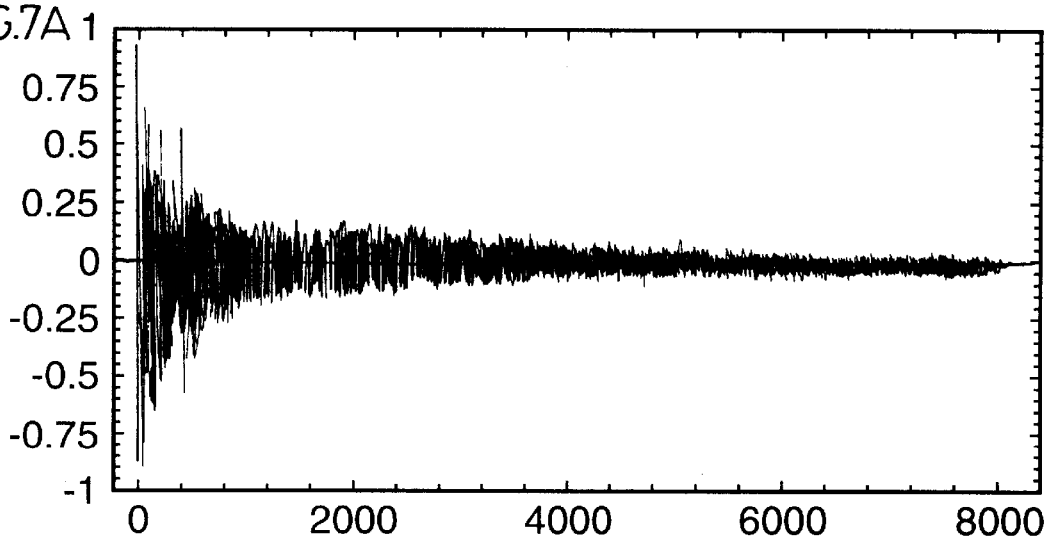
FIG. 7 is a graph of a glass break signal representative of breaking 7 mm wired glass sample 18"×18" broken in a frame, followed by a graph of the output of the autocorrelation function for this sample.
Figure 7B:
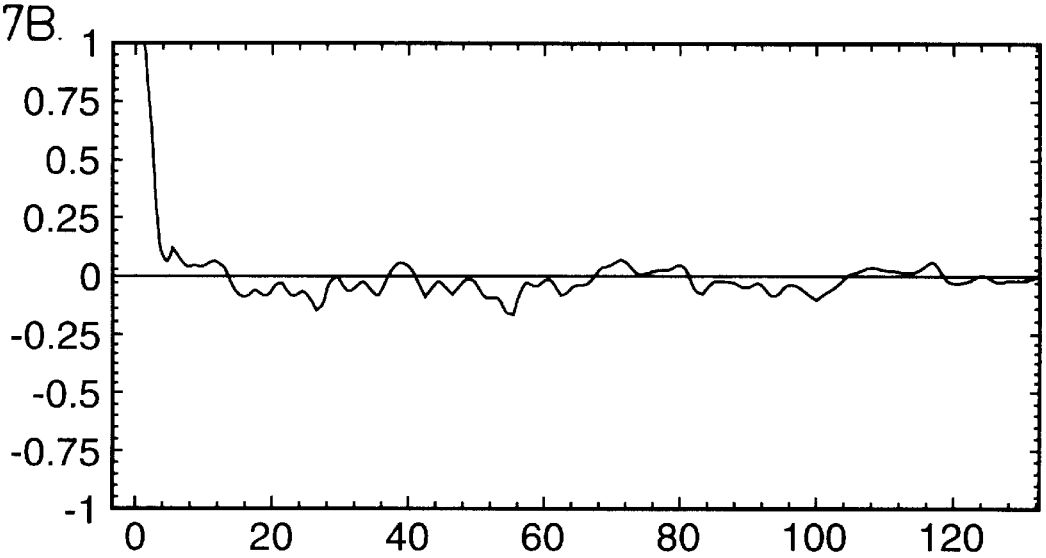
Figure 8A:
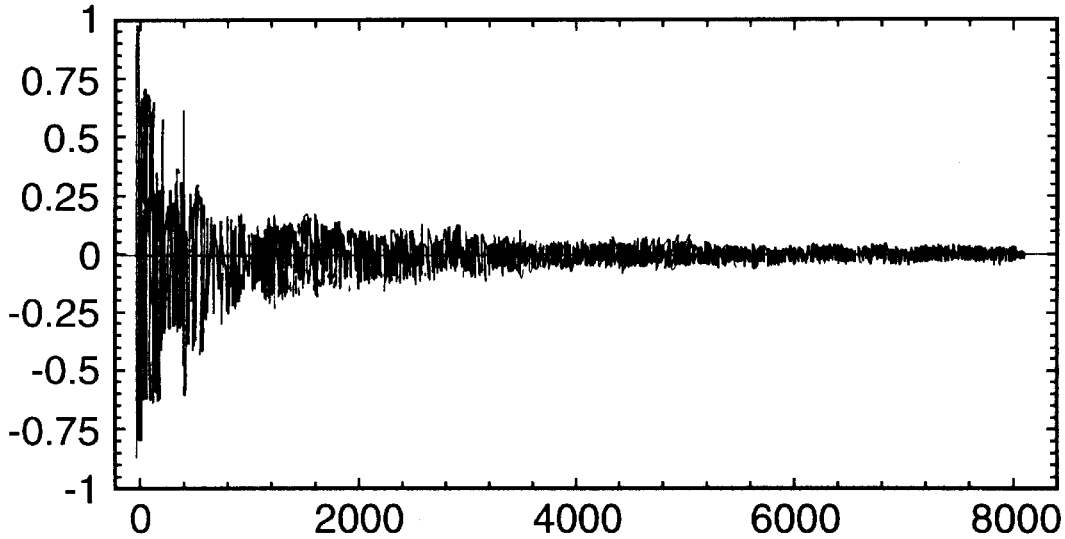
FIG. 8 is a graph of the sample signal of FIG. 7, followed by a graph of the cross-correlation output, followed by the summation of the absolute value of the cross-correlation output.
Figure 8B:
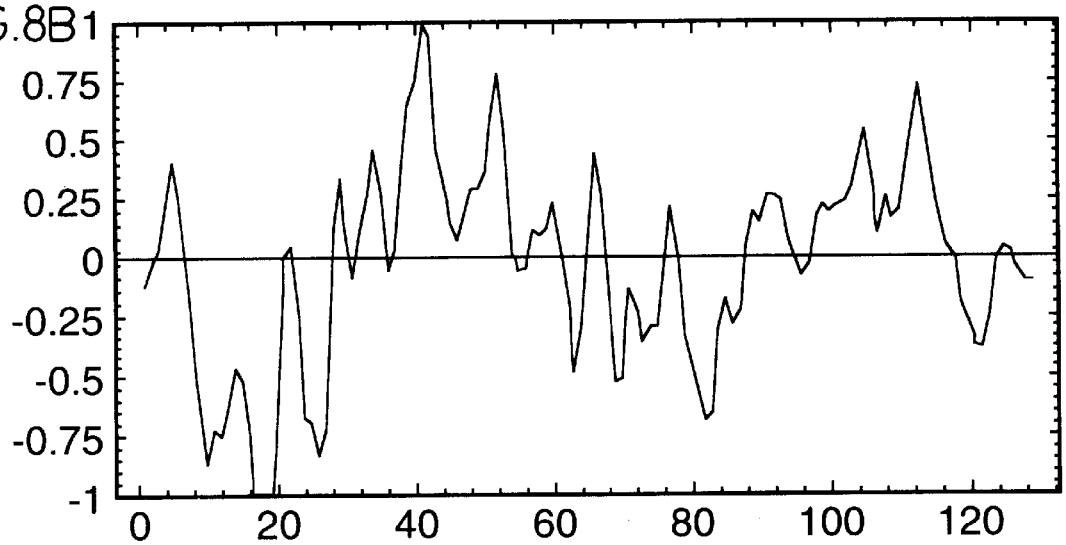
Figure 8C:
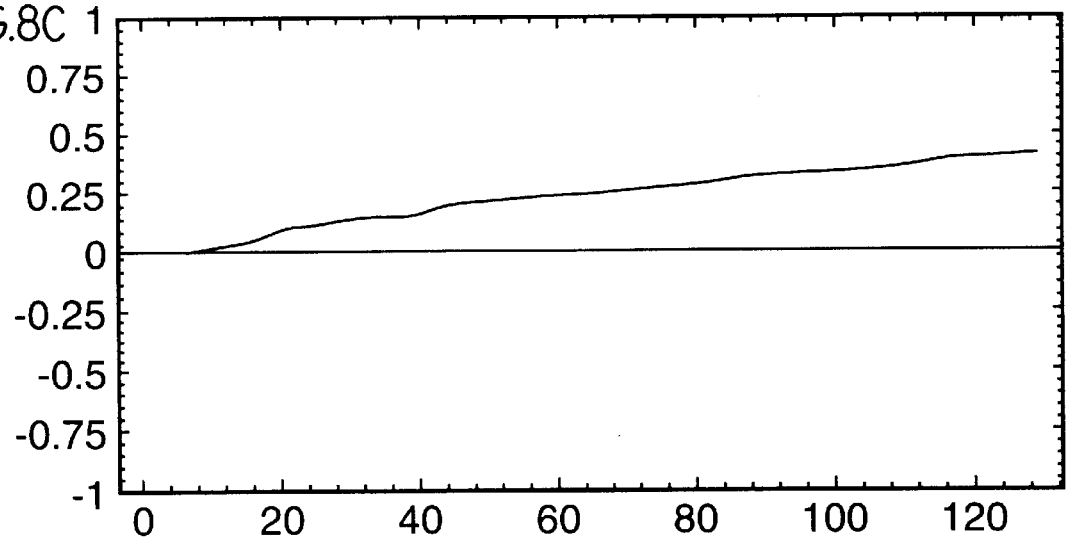
Figure 9A:
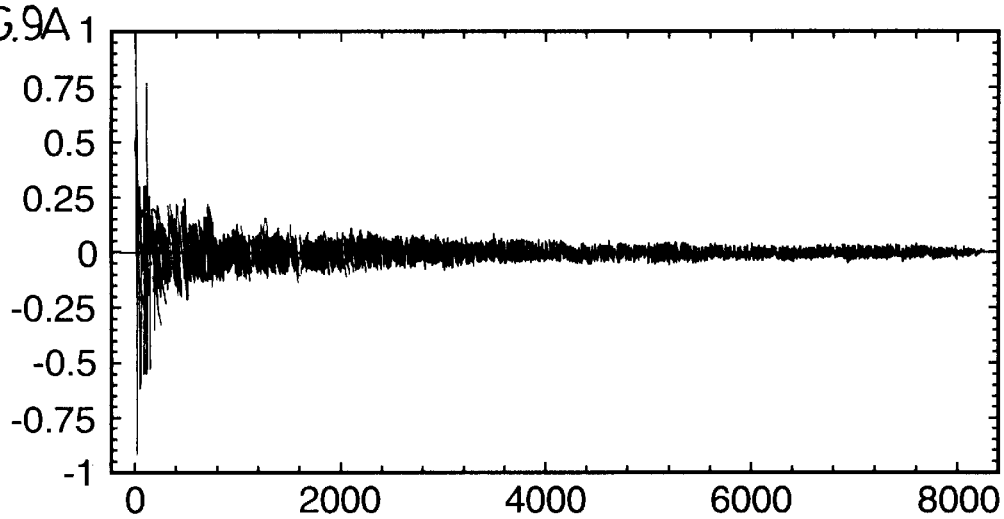
FIG. 9 is a graph of a glass break signal representative of breaking 6 mm laminated glass sample 18"×18" broken in a frame, followed by a graph of the output of the autocorrelation function for this sample.
Figure 9B:
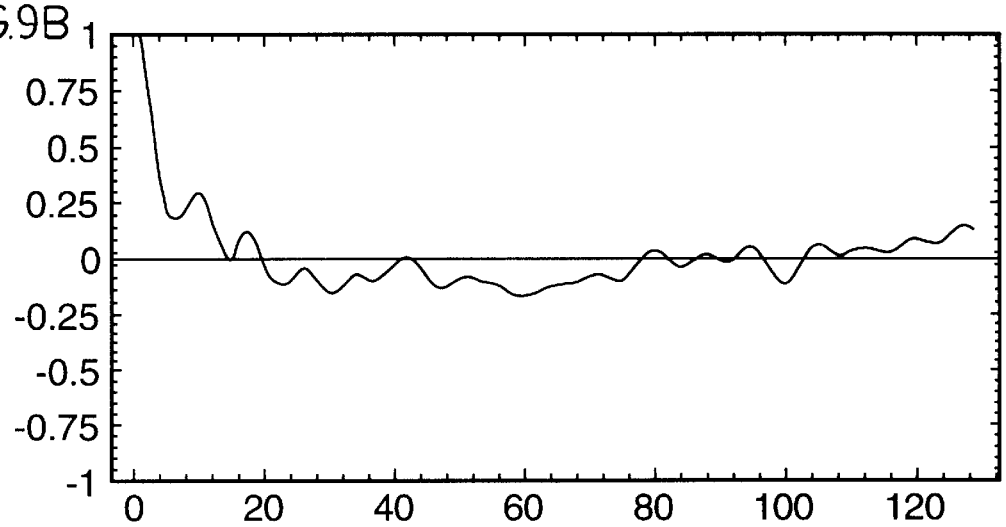
Figure 10A:
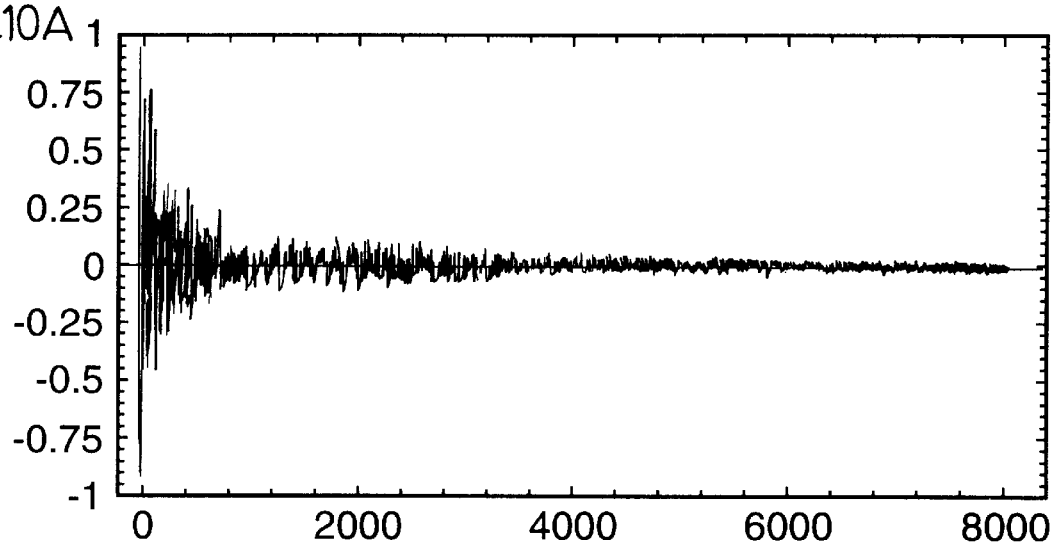
FIG. 10 is a graph of the sample signal of FIG. 9, followed by a graph of the cross-correlation output, followed by the summation of the absolute value of the cross-correlation output.
Figure 10B:
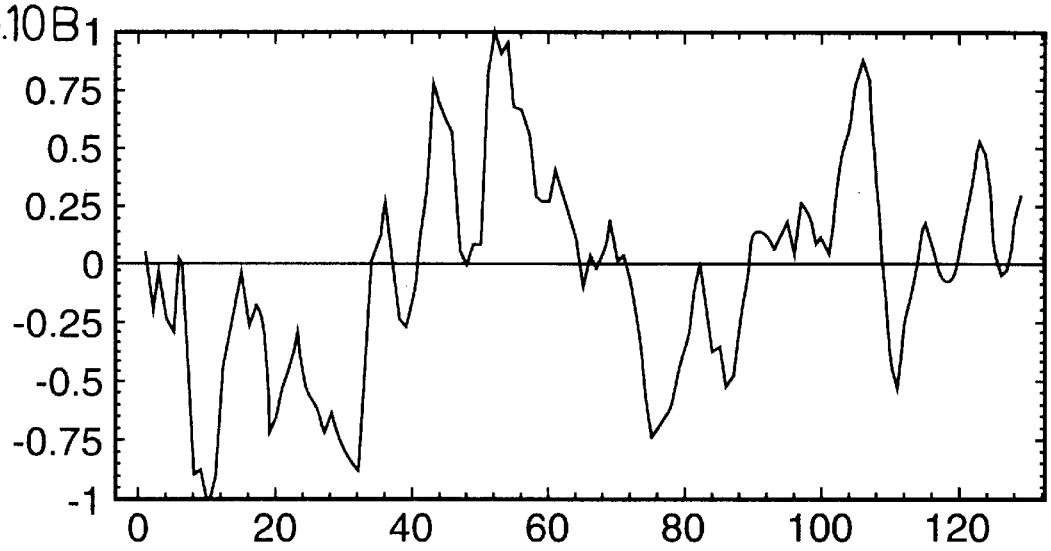
Figure 10C:
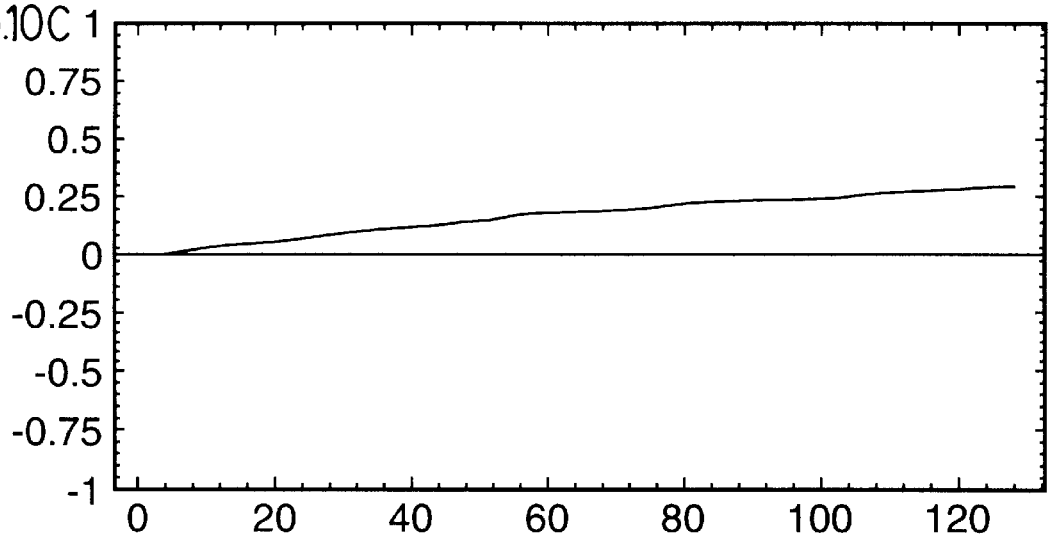
Figure 11A:
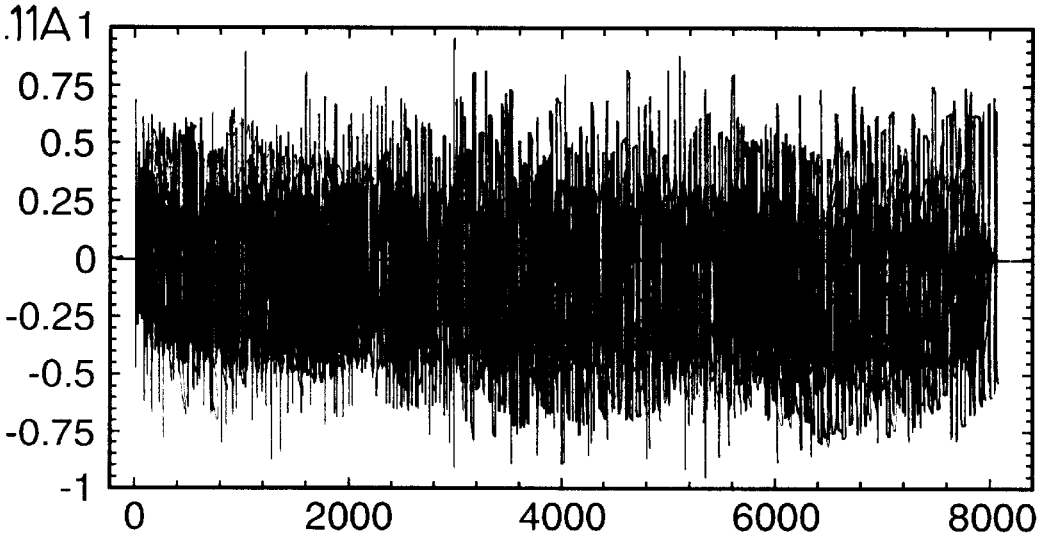
FIG. 11 is a graph of a filtered signal from a precision noise generator, followed by a graph of the output of the autocorrelation function for this sample.
Figure 11B:
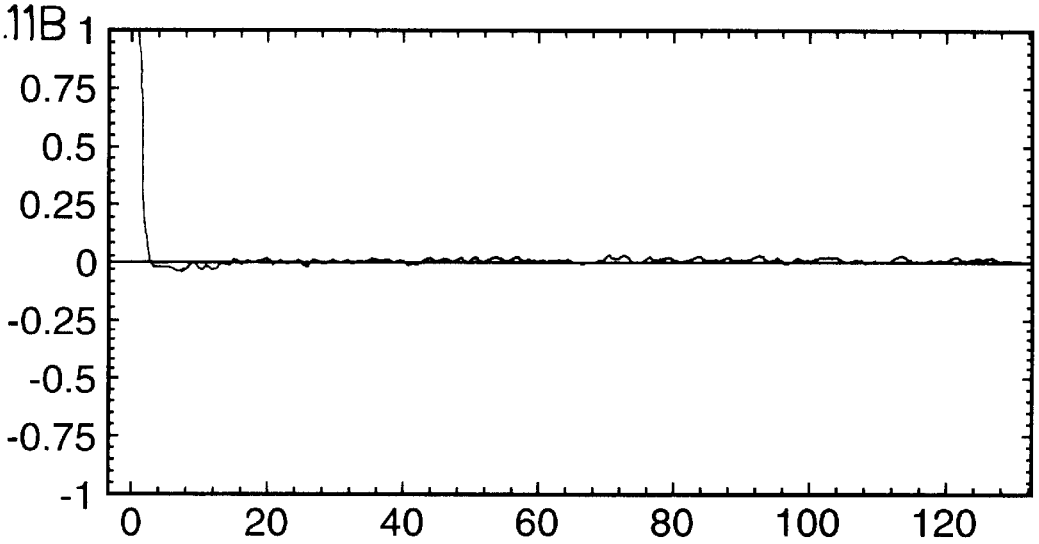

In order to carry out the statistical analysis, the signal is first processed by filtering to remove the low frequency components, followed by sampling of the signal and statistical analysis thereof. In particular, the signal is analyzed using correlation techniques, in particular cross-correlation and autocorrelation are used. Autocorrelation accurately extracts periodicity in the signal, and in a glass shattering event, the higher frequency components are found to have no significant periodicity (i.e. random). The cross-correlation technique is used in combination with a typical glass shattering high frequency reference signal (FIG. 2A) and this alone, in many cases, is able to distinguish sudden changes in the signal caused by a glass break event from other transient non-glass break events. For improved reliability, two different means of analysis of the signal are used (i.e. cross-correlation and autocorrelation).

As shown in FIG. 1, the system includes a condenser microphone 1, an amplifier generally shown as 2, a high-pass filter 3 fed in parallel to an autocorrelator generally shown as 4, a cross-correlator generally shown as 6, and an envelope detection function 12. The autocorrelator 4 in combination with the autocorrelation and pattern classification arrangement 5 determines the degree of periodicity (low periodicity indicates a high degree of randomness), the cross-correlator 6 in combination with cross-correlator pattern classification arrangement 7 provides analysis relative to the filtered reference glass shattering signal (FIG. 2A), and the envelope detection and classification 12 assesses the signal for the typical initial rapid increase associated with glass shattering followed by a nonlinear decay similar to an exponential type decay. These outputs can then be fed to the decision block 8 and, based on the various criteria thereof, alarm outputs 9 will be produced.

This separate processing of the high frequency components using at least two statistical procedures has been effective in distinguishing glass shattering events from common sources of false alarms.

The condenser microphone is a transducer which converts the nearby air pressure fluctuations into an electrical output signal which is processed by the detector. Its frequency response is approximately uniform from 50 Hz to 12 kHz, where the response drops off sharply. The transducer is the predominant frequency selection device in this system, although other arrangements can be used.

The high-pass filter 3 and amplifier 2 filters and amplifies the microphone electrical output signal to prepare it for analysis. The high-pass filtering is used to eliminate the high amplitude, periodic, low frequency components of the glass break event, thereby preserving dynamic range and allowing only the higher frequency components of the glass break event to be passed to the remaining algorithms or functions. The low frequency components partially depend on location, type of frame used to hold the glass, and the size of the glass pane. Therefore, these low frequency components are difficult to distinguish from common sources of false alarms. By eliminating the low frequency components, the confidence of prediction is increased since the higher frequency components of the actual glass shattering event will occupy the majority of the available dynamic range of the system. The filter is preferably a "Butterworth" type with a smooth amplitude response and linear phase delay in the pass band.

The amplified higher frequency components of the output signal are analyzed by the autocorrelator 4. In theory, the correlator performs an N-sample autocorrelation of the higher frequency components. The mathematical operation performed on the higher frequency components sample is given by:

$$Rxx(\S)\approx 1/N\Sigma x(t)\times(t+\S)\Delta t$$

The autocorrelation function computes the average product of a signal, "x(t)" and a time-shifted version of itself, "x(t+§)", over a particular period of time, "T". The arithmetic summation performed by the autocorrelation function causes unrelated (random, or uncorrelated) current and future signal components to cancel each other out, leaving behind the periodic (or correlated) components from the input signal. This technique has been utilized for years in communications receivers, which must extract signals buried in noise. Due to the noise cancelling feature of this function, this technique is used to extract frequency domain information without resorting to operations in the frequency domain (i.e. Fast Fourier Transform (FFT) analysis). By performing statistics on the zero-crossing periods of the autocorrelation output, extract periodicity information can be extracted from the input signals. Some examples of autocorrelation are shown in FIGS. 3, 5, 7, 9, 11, 13, 15, 17 and 19.

The various graphs of the cross-correlation and autocorrelation of the various signals are based on a sample period of approximately 186 milliseconds and 8192 samples. The time between samples is approximately 22.7 microseconds.

In order to allow comparison between the various graphs, the amplitude ranges of all signals and correlation plots are all scaled relative to the maximum values in the original data and normalized.

The third graph shown with respect to the cross correlation function of the various samples is a rudimentary post processing mechanism developed to distinguish glass break events from non-glass break events using the cross-correlation output. The scaling for this plot was derived to be relative to the maximum of the summed cross-correlation output between the pattern and itself (this situation being the condition of maximum agreement).

Figure 22A:
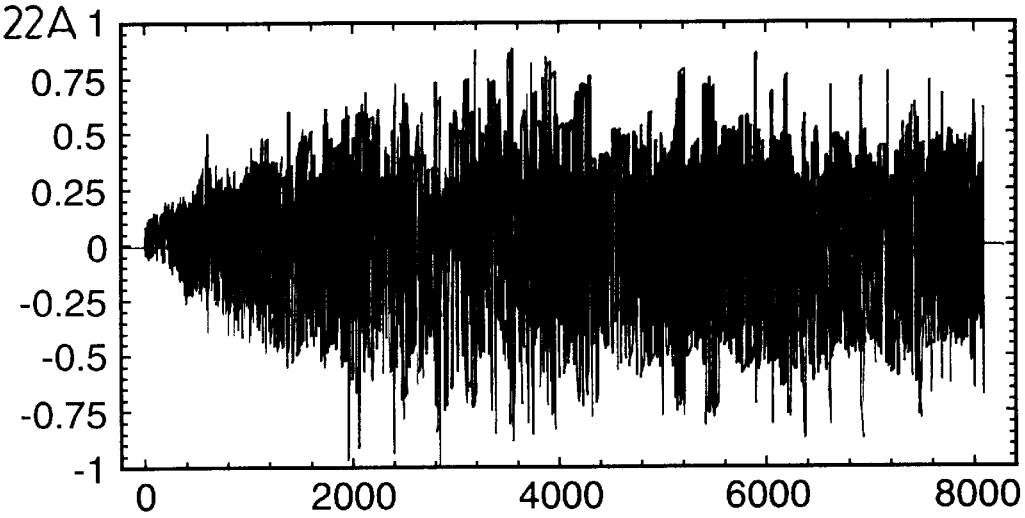
FIG. 22 is a graph of the sample signal of FIG. 21, followed by a graph of the cross-correlation output, followed by the summation of the absolute value of the cross-correlation output.
Figure 22B:
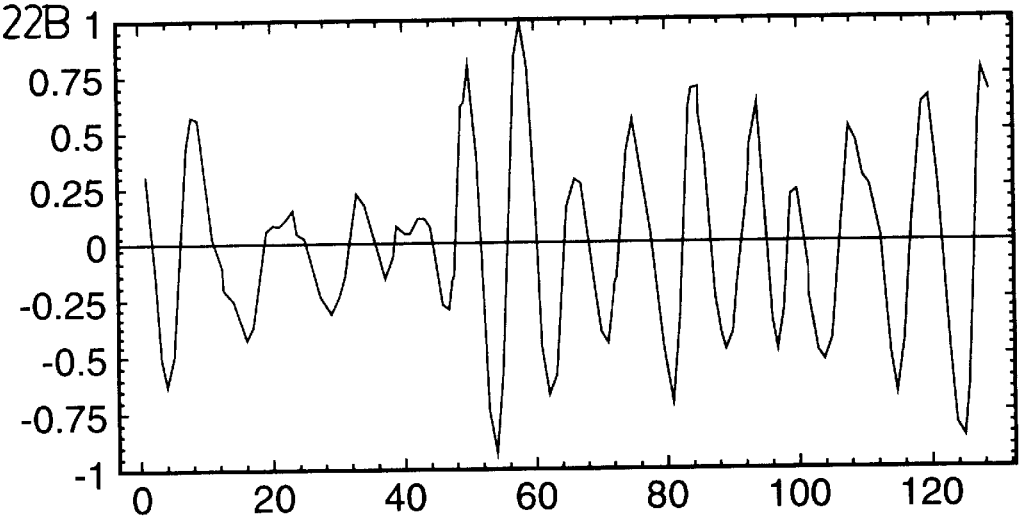
Figure 22C:
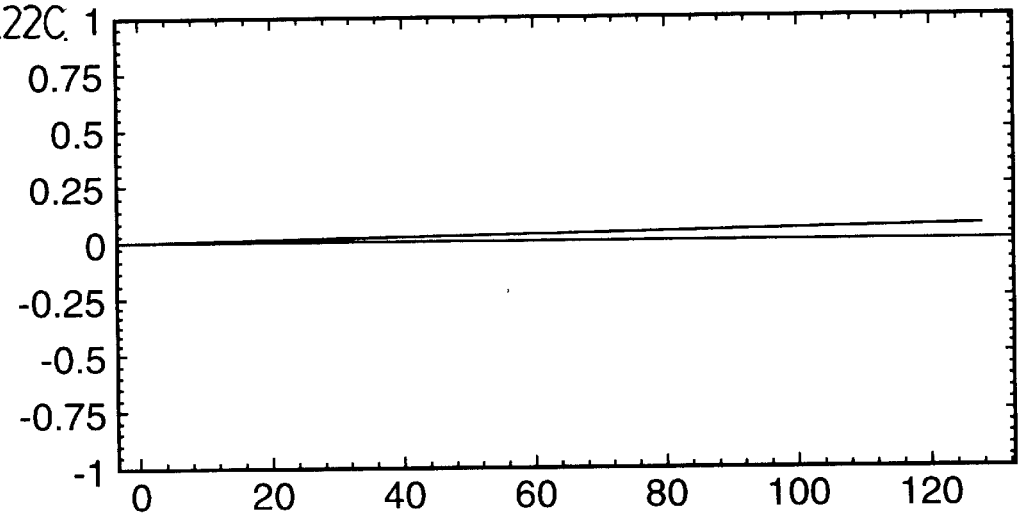
Figure 23A:
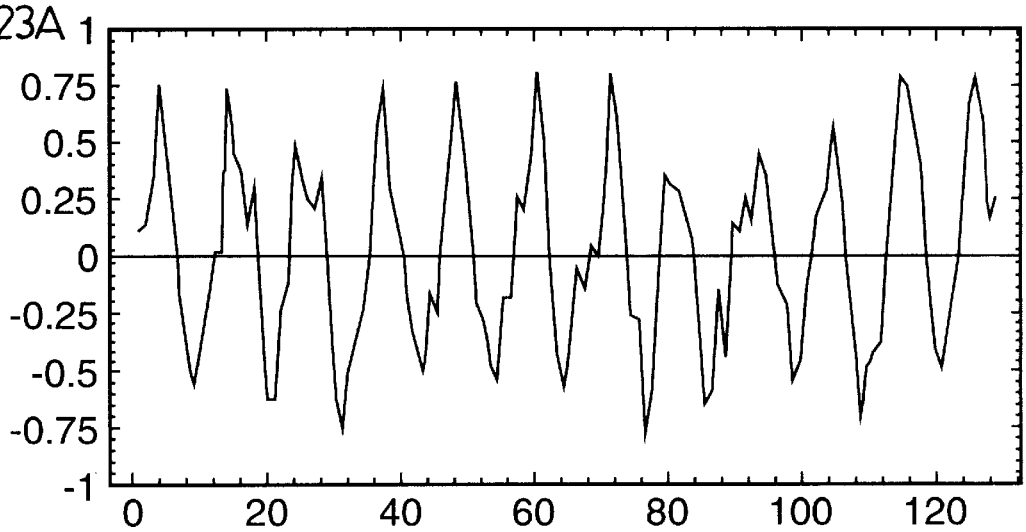
FIG. 23 is a graph of a mixed noise and 4000 Hz sine wave signal, followed by a graph of the output of the autocorrelation function for this sample.
Figure 23B:
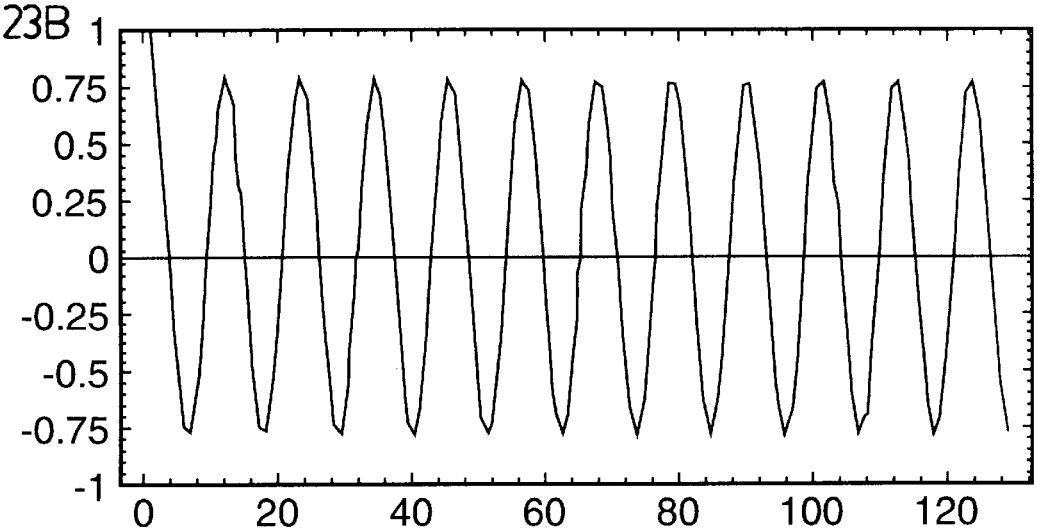

In summary, the autocorrelation function or an approximation thereof is used to extract the "wide-bandness" of input signals, and in doing so, provides immunity to many false alarm causing sounds, which are periodic in nature (as shown in FIGS. 13, 25, 17, 19 and 21). However, there may be situations where there is a large source of air turbulence in the protected area. This may produce whistling noises (see FIG. 22), which are random in nature. This necessitates the need for a "second opinion" correlation mechanism, which computes the degree of correlation of the input signal to a stored reference signal representative of a higher frequency components of a glass break event which has non-deterministic characteristics and of a certain envelope pattern. A single criterion is not particularly satisfactory in declaring a transient event a glass shattering event, however, with two or more criteria which indicate a glass break event has occurred, a much higher confidence level is realized.

As can be seen, the glass break signal, when processed by the autocorrelation function (FIG. 3, 5, 7 and 9), has characteristics exemplified by the wide-band nature of the glass shattering signal. This feature, in combination with the cross-correlator (see FIG. 4, 6, 8 and 10), has been used to accurately distinguish glass shattering events from other common transient events which previously have caused false alarms, such as those indicated in FIGS. 12 through 23.

Cross-correlation alone, in some cases, is able to distinguish the higher frequency components of a glass break event from other transient events which previously caused false alarms, since the reference signal used in the cross-correlation is random (similar to a glass break event) and can be distinguished from most other transient events constant noise >T which produce signals having a high degree of periodicity in the higher frequency components. Positive cross-correlation provides a convenient approach for detecting a glass break event, particularly when used with other investigative techniques. It can be appreciated an approximation of the cross-correlation function can be used to reduce costs or processing time.

A reference glass break event signal, generally limited to the high frequency components, can be created by using known arrangements for selecting the frequencies followed by adjusting the amplitudes to fit the envelope of a glass break event (i.e. rapid increase followed by generally exponential decay). Any reference signal that has a high correlation with glass break events in general can be used. There may also be other reference signals which can distinguish glass break events from other transient events.

Wide-bandness and random have been used to describe the non-deterministic characteristic of a glass break event. The conventional sources of false alarms have a significant degree of periodicity (more predictable) and this property is used to distinguish these transient events from a transient glass break event. Several different techniques can be used to improve the confidence in predicting whether a detected transient event is a glass break evert. For example, a low assessment of periodicity together with a significant correlation to the reference glass break signal is more reliable than either measurement alone. Further reliability is possible by examining the envelope of the transient event signal for a sharp rise followed by a nonlinear decay similar to an exponential decay. Each of these measures are more effective when the low frequency components (preferably below about 1 kHz) are removed as these components often are periodic in a glass break event and therefore mask the results to some extent.

Elimination of the low frequency components while maintaining a large higher frequency band maintains most of the information associated with the transient event and therefore is useful in distinguishing the likely source thereof. All of this useful information has been maintained, however, it is possible to analyse a reduced portion thereof if desired and sufficient reliability is achieved.

It should be noted that the time duration of analysis may be in the range of ¼ to ½ seconds, and therefore, is not necessarily the entire glass shattering event with secondary shattering, such as the glass shattering again on impact with the floor.

As illustrated by the integration plots, glass break events generally possess a higher degree of overall correlation to the glass break pattern (i.e. FIG. 2A) than do non-glass break events.

Figure 13A:
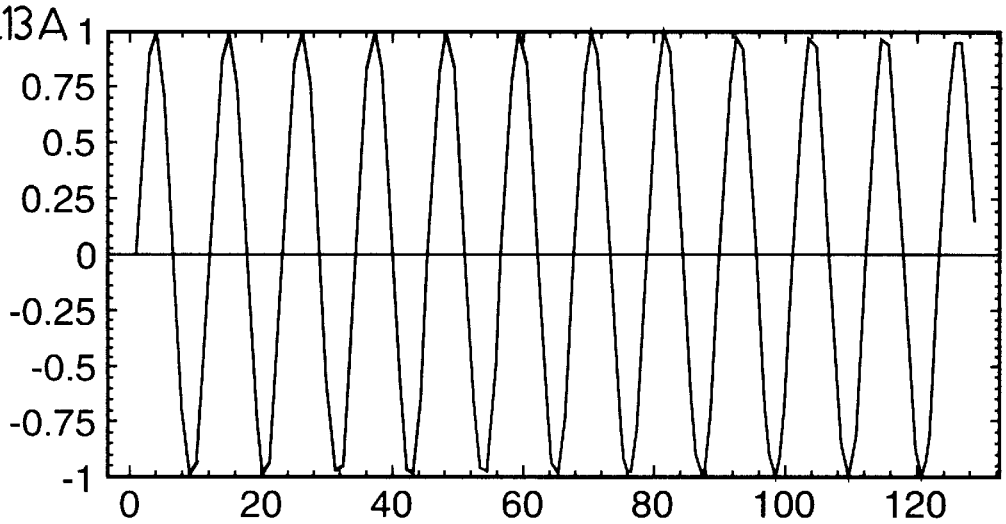
FIG. 13 is a graph of a 4000 Hz sine wave signal, followed by a graph of the output of the autocorrelation function for this sample.
Figure 13B:
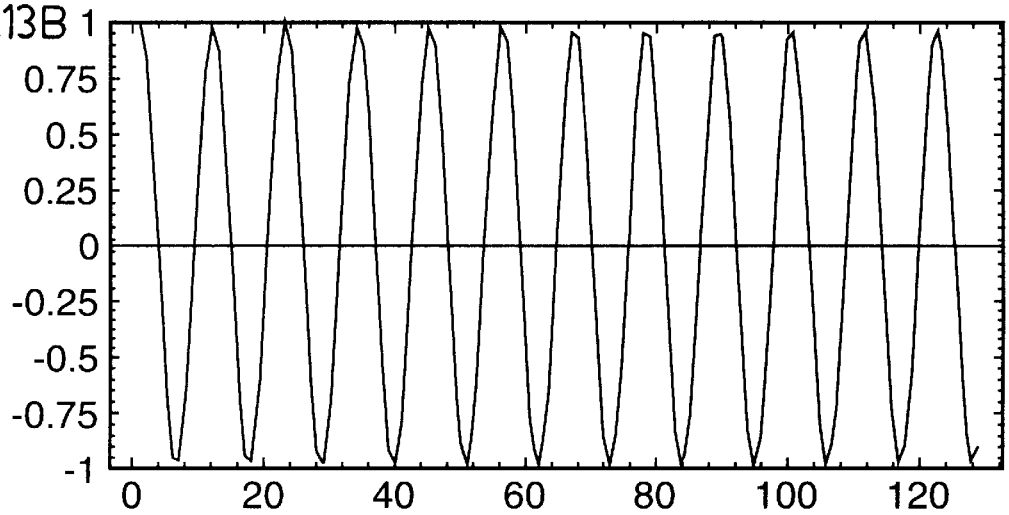
Figure 14A:
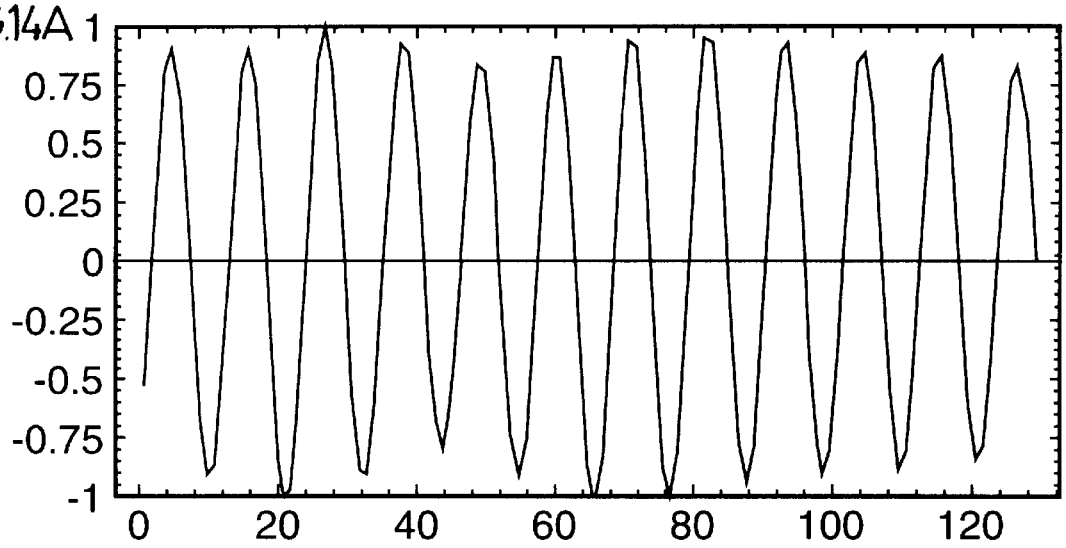
FIG. 14 is a graph of the sample signal of FIG. 13, followed by a graph of the cross-correlation output, followed by the summation of the absolute value of the cross-correlation output.
Figure 14B:
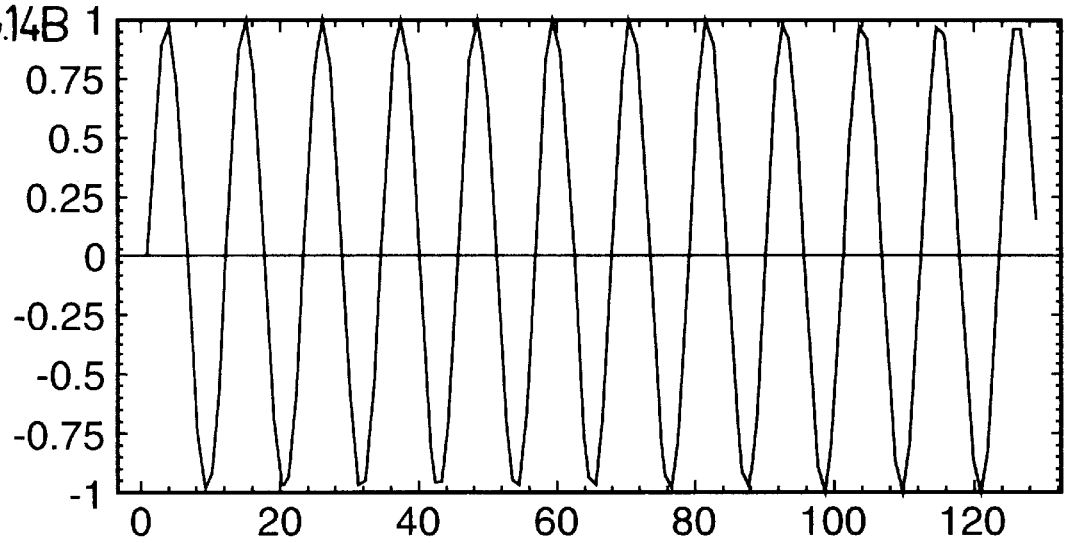
Figure 14C:
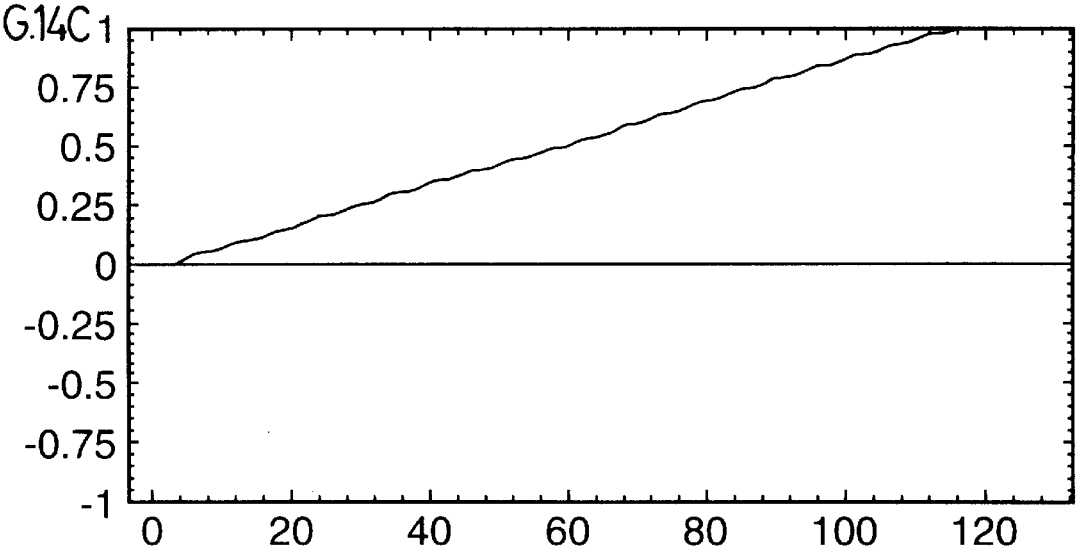
Figure 15A:
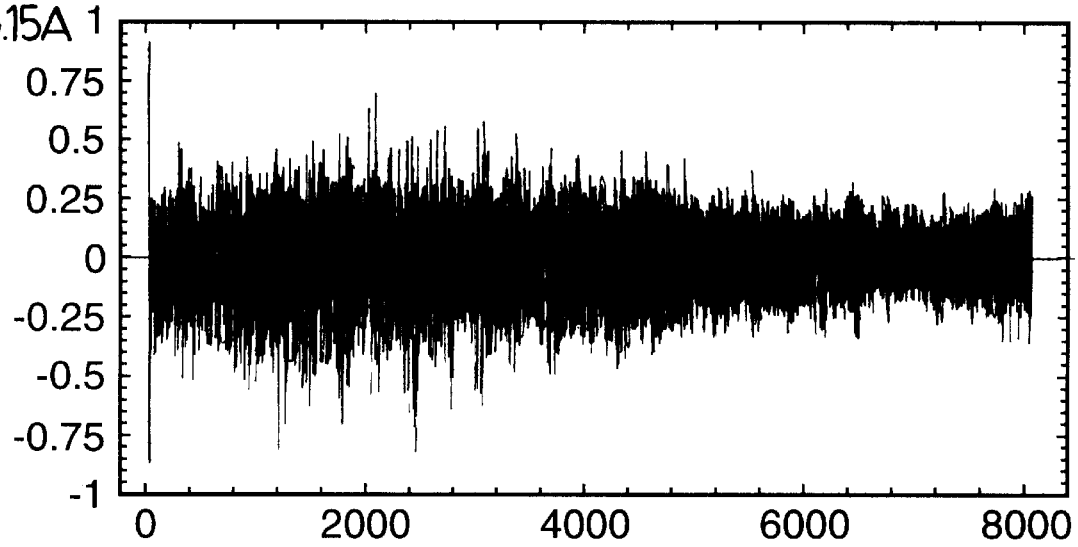
FIG. 15 is a graph of a filtered sample signal produced by dropping a wrench on a hard floor, followed by a graph of the output of the autocorrelation function for this sample.
Figure 15B:
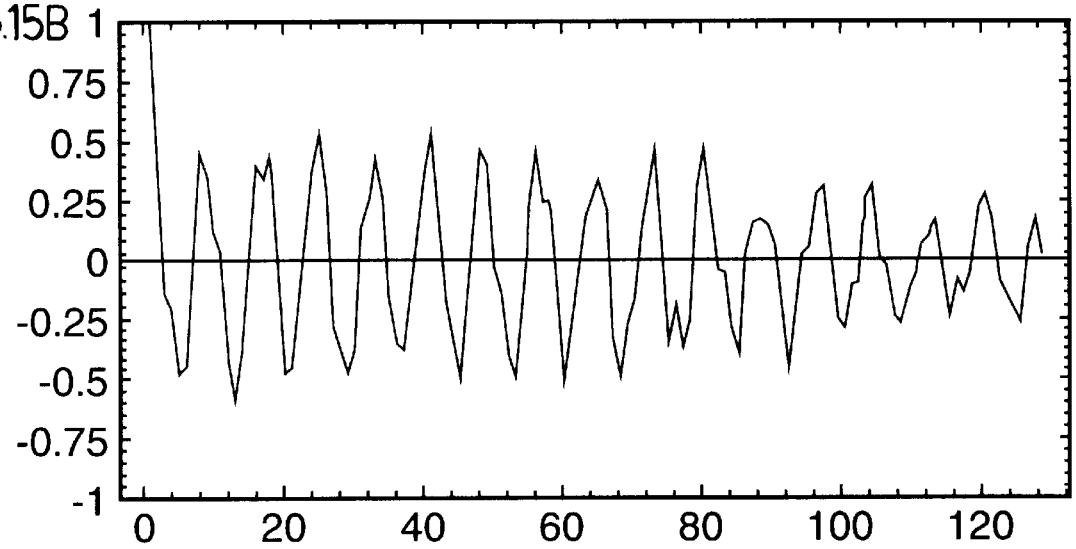
Figure 16A:
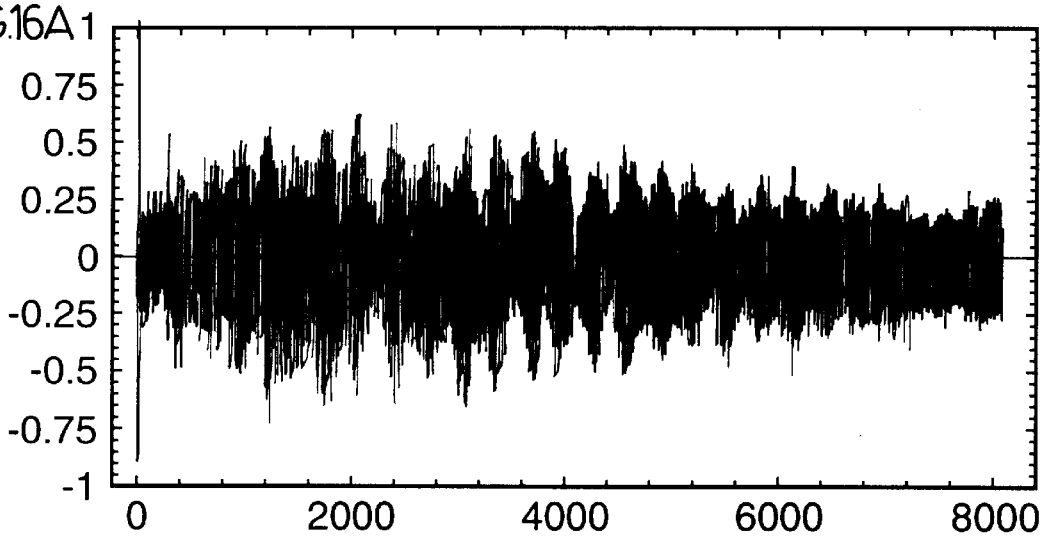
FIG. 16 is a graph of the sample signal of FIG. 15, followed by a graph of the cross-correlation output, followed by the summation of the absolute value of the cross-correlation output.
Figure 16B:
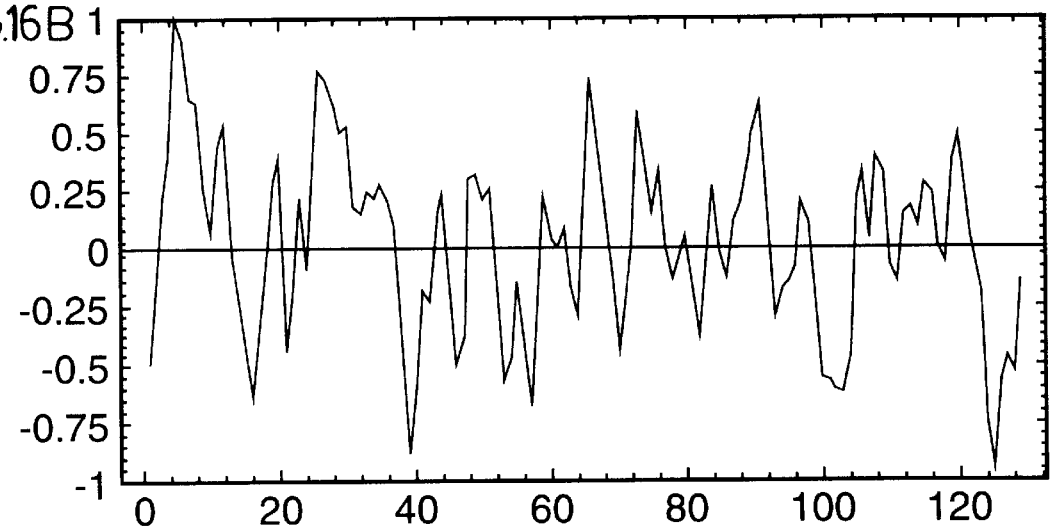
Figure 16C:
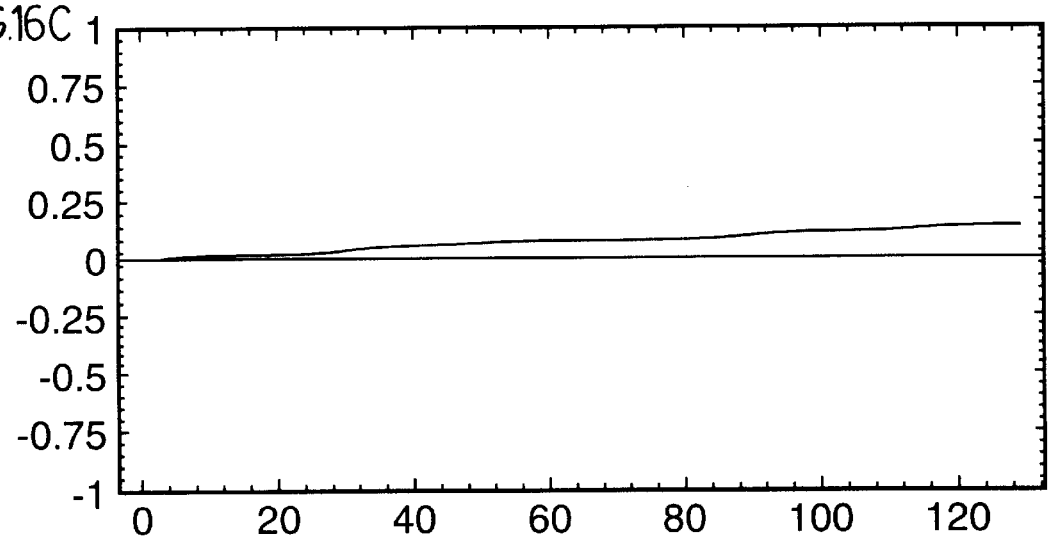
Figure 17A:
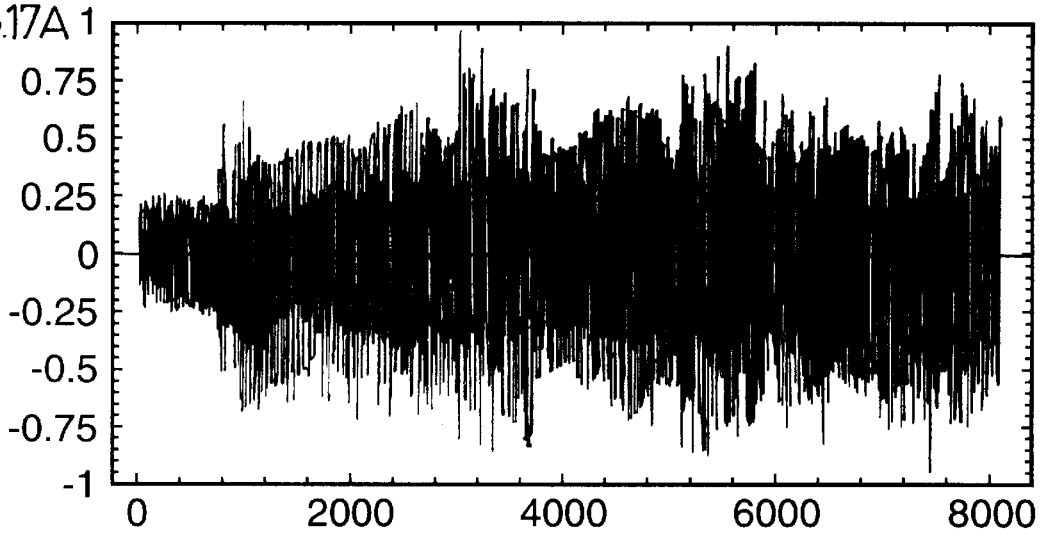
FIG. 17 is a graph of a telephone set ring signal, followed by a graph of the output of the autocorrelation function for this sample.
Figure 17B:
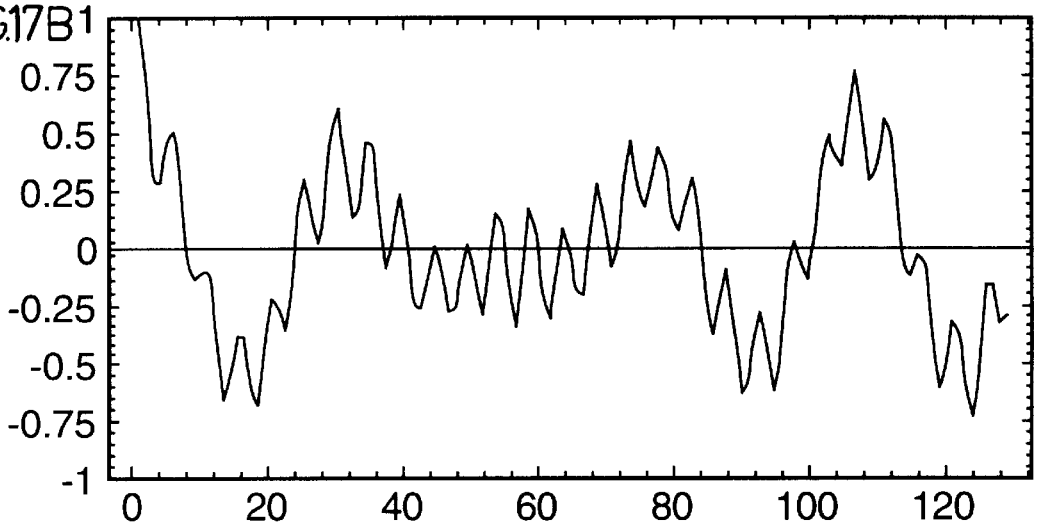
Figure 18A:
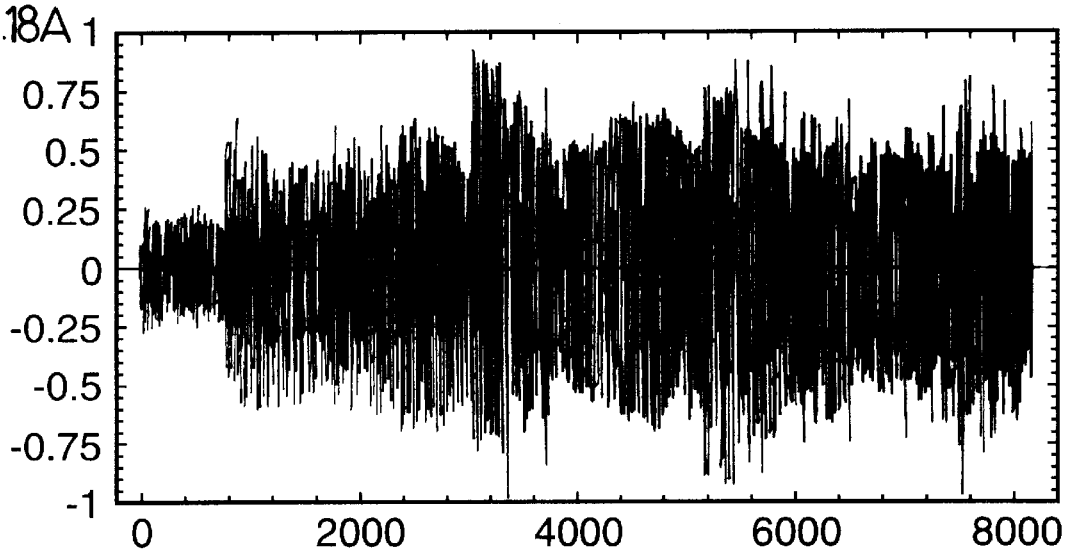
FIG. 18 is a graph of the sample signal of FIG. 17, followed by a graph of the cross-correlation output, followed by the summation of the absolute value of the cross-correlation output.
Figure 18B:
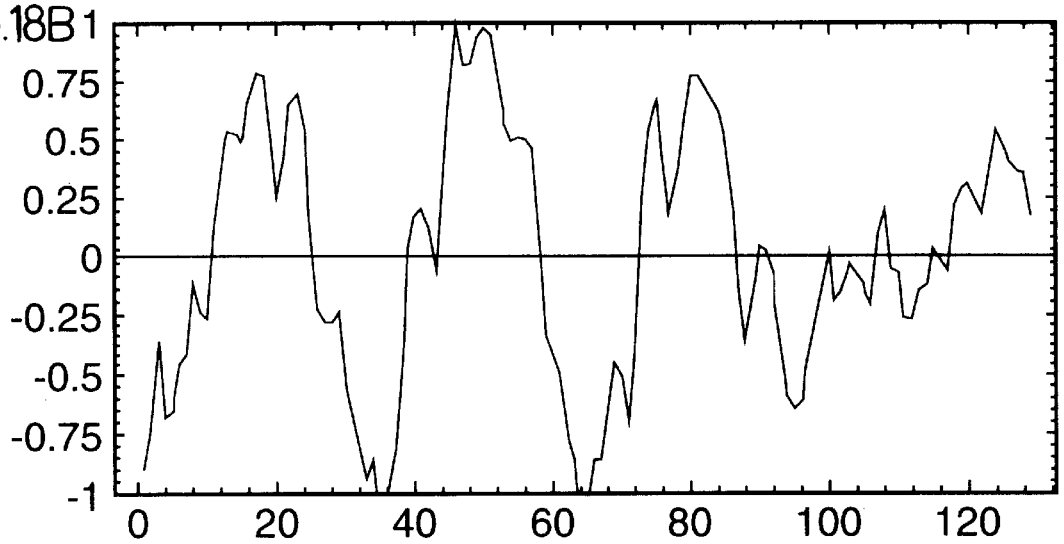
Figure 18C:
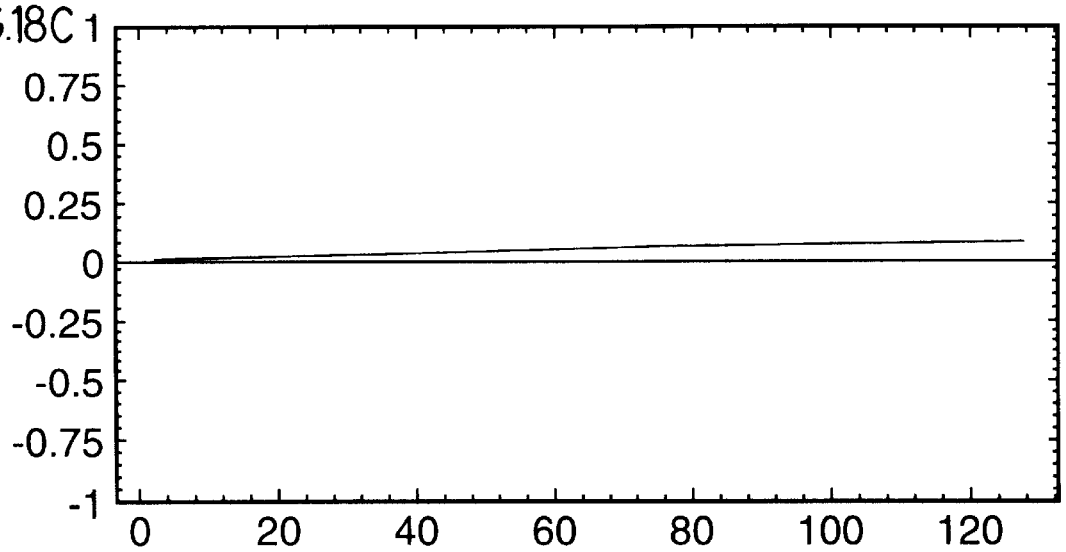
Figure 19A:
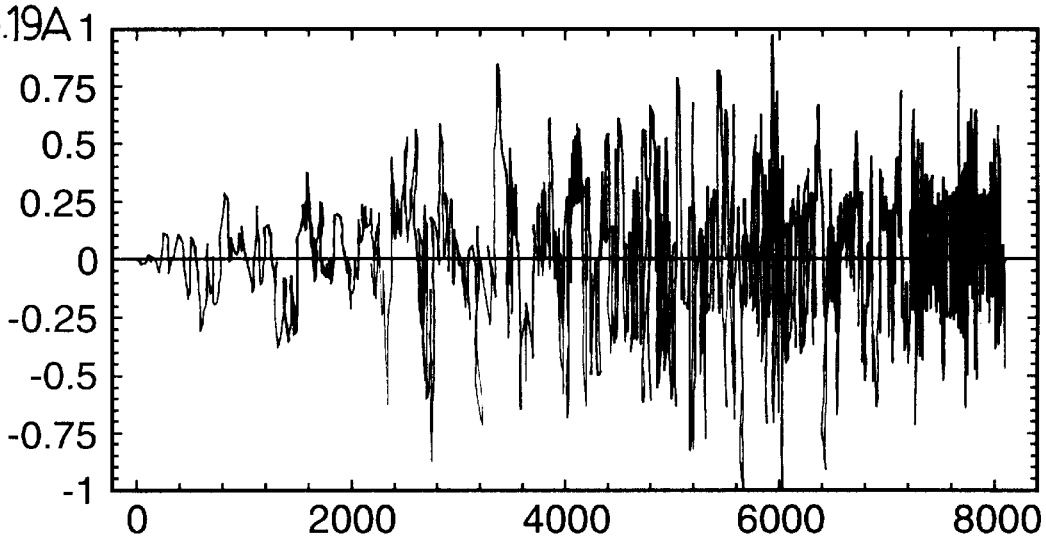
FIG. 19 is a graph of a thunder storm signal, followed by a graph of the output of the autocorrelation function for this sample.
Figure 19B:
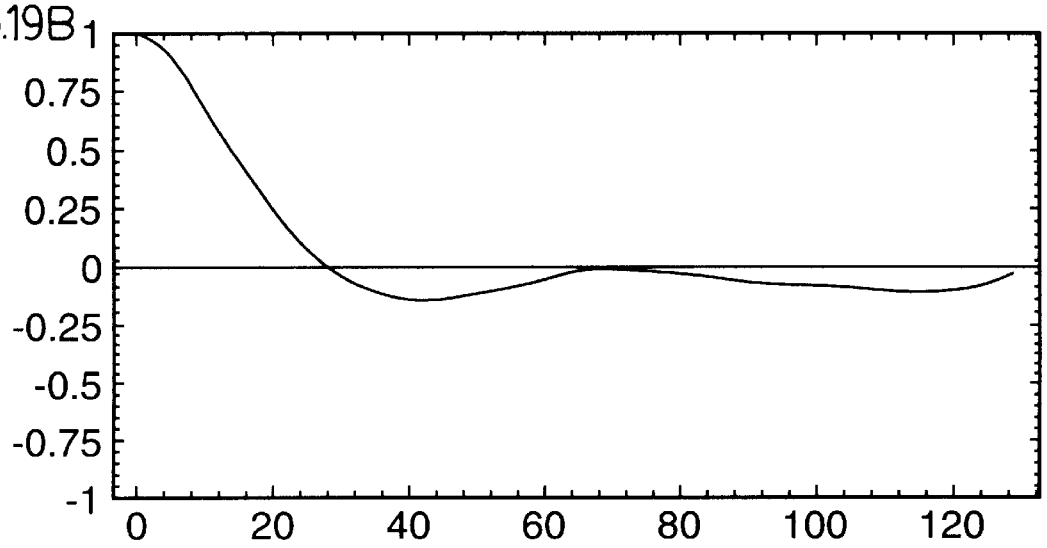
Figure 20A:
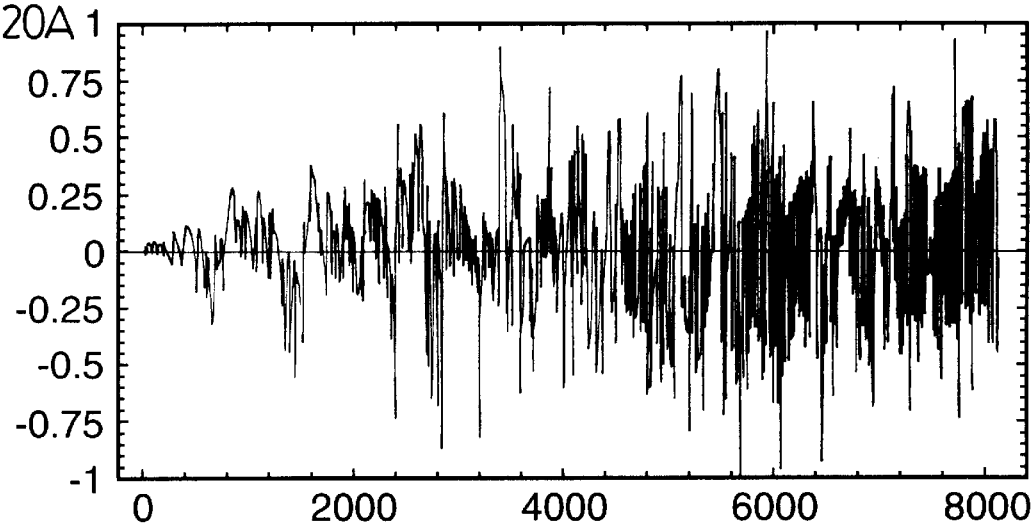
FIG. 20 is a graph of the sample signal of FIG. 19, followed by a graph of the cross-correlation output, followed by the summation of the absolute value of the cross-correlation output.
Figure 20B:
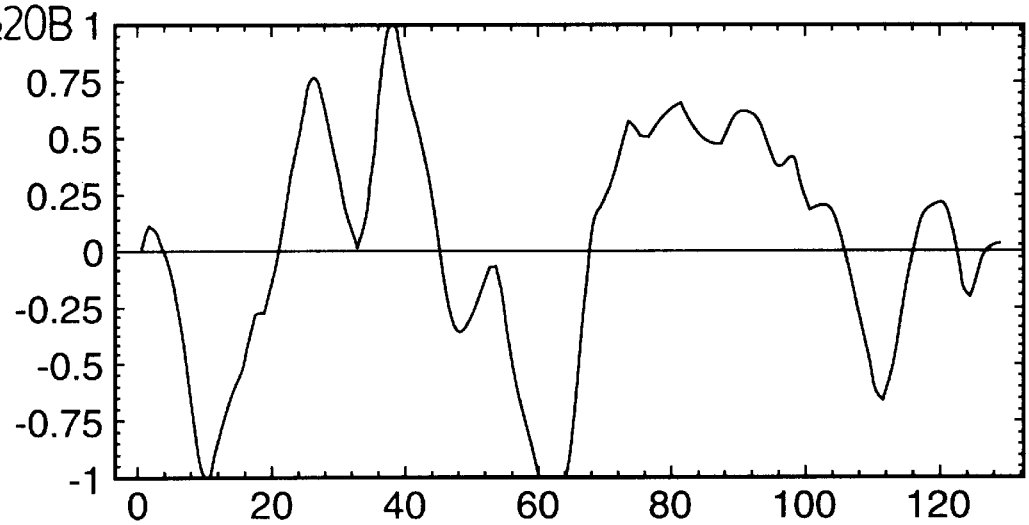
Figure 20C:
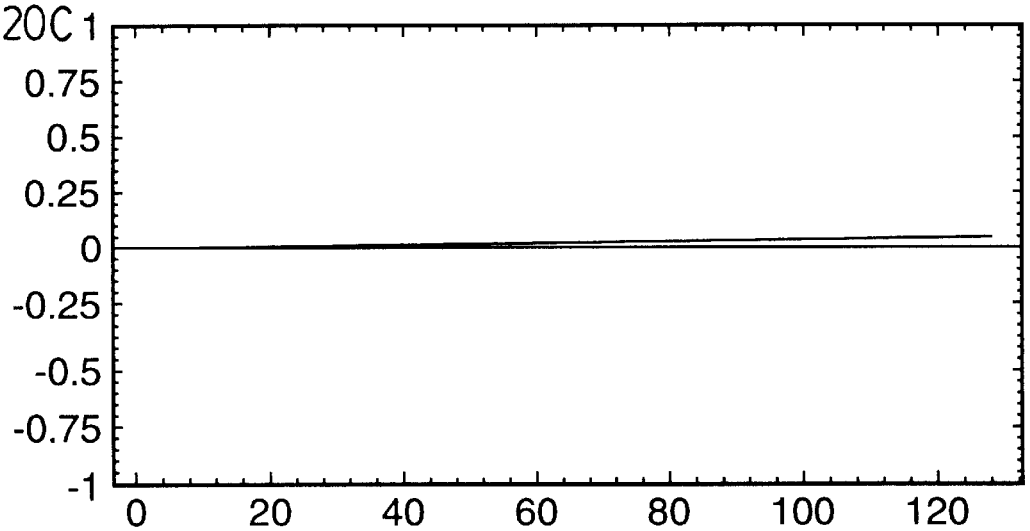
Figure 21A:
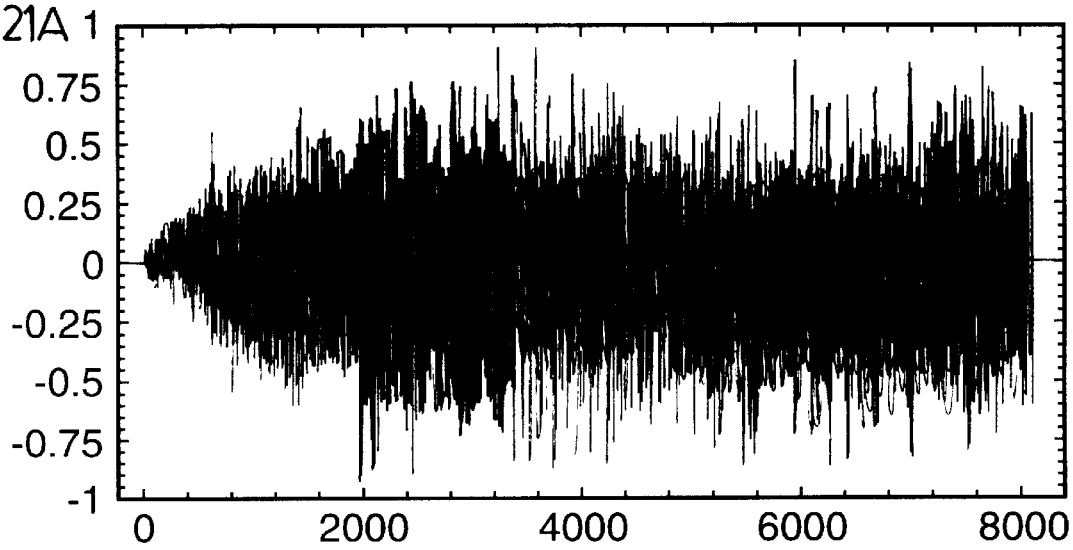
FIG. 21 is a graph of a human voice producing the sound "pshhhhhh", followed by a graph of the output of the autocorrelation function for this sample.
Figure 21B:
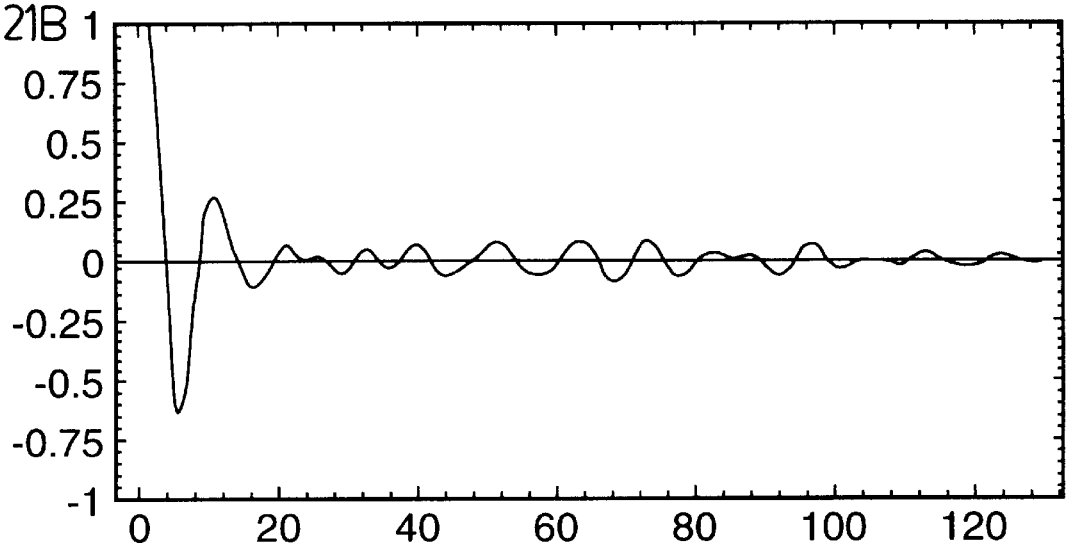

The amplitude dependency of the function is evident in the output from the 4 kHz tone signal (FIG. 13). The tone signal amplitude is significantly greater than the average amplitude of the pattern, therefore, the 4 kHz components within the pattern are amplified, producing a degree of positive correlation which is higher than that given when the pattern is mixed with itself. This situation illustrates the need for other post processing mechanisms which are less amplitude dependent than direct integration of the cross-correlation output. In terms of providing a first order evaluation of the degree of correlation, the integration algorithm is found to be adequate, but is supplemented by analysis from the autocorrelation output.

It has been found that the non-deterministic nature of the glass break event allows it to be statistically distinguished from other non-glass break event signals and thus, provides a reliable apparatus and method for distinguishing glass break events. The particular statistical techniques disclosed are only representative of techniques which can identify this non-deterministic nature of the glass break event and the invention is not limited to these particular techniques, although they are readily available and thus, suitable for this approach. Simplifications of these techniques can be used to allow for a low cost detector. Thus, the invention realizes that there are certain low frequency components of a glass break event that should be removed to allow improved statistical analysis of higher frequency components, which due to their non-deterministic nature, can be distinguished from other non-glass break event sources.

One useful measure of the degree of wide-bandness in the output signal is made by using the Degree of Correlation information to determine Maximum Peak Value (Average of the Absolute Value of all Peak Values). With noise, the ratio is very high (approximately 1000 or more), whereas periodic signals have a low ratio (approximately 1). A glass shattering signal has an intermediate ratio (approximately 10). This ratio provides a convenient, inexpensive assessment of the degree of correlation. Another measure of the information contained in the degree of correlation in autocorrelation, is the time to the first zero crossing of the signal. Note how a thunderstorm signal (powerful low frequency) has a long duration to the zero crossing, whereas with a glass shattering event, the duration is short. Autocorrelation provides assessment of the number of frequencies in the signal (i.e. whether the signal is wide-band).

The above measures illustrate how it is possible to extract useful information from autocorrelation output and are not the only possible measures.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A glass break detector comprising a transducer for sensing acoustic pressure and a processing arrangement which processes an output signal of said transducer using statistical sampling techniques, said statistical sampling techniques analysing said signal and also determining whether the signal is non-deterministic and producing an alarm when the analysis determines the signal has the required shape and is non-deterministic.

2. A glass break detector as claimed in claim 1 wherein said statistical techniques assess the amount of periodicity in the signal and the amount of correlation of the signal with a reference event signal typical of a glass break event and producing an alarm signal when there is a transient event which causes a change in the signal having 1) no significant periodicity, and 2) a significant correlation with the reference glass break signal.

3. A glass break detector as claimed in claim 2 wherein said processing arrangement uses an autocorrelation technique and a cross-correlation technique to determine the extent of periodicity and correlation of the signal.

4. A glass break detector as claimed in claim 2 wherein the transducer is a microphone and the output signal of the microphone is passed through a high pass filter which removes low frequency components.

5. A glass break detector as claimed in claim 4 wherein frequencies less than about 1 kHz do not pass through the high pass filter.

6. A glass break detector as claimed in claim 5 wherein an approximate autocorrelation technique is used to determine the extent of periodicity in the signal.

7. A glass break detector for detecting the breaking of glass comprising an acoustic transducer which is capable of producing a wide band electrical output signal, a processing arrangement for processing sudden changes in the electrical signal caused by a transient event, said processing arrangement filtering the output signal through a high pass filter and analysing the filtered signal to identify transient events and investigate the filtered signal of each transient event to determine if the filtered signal is non-deterministic in nature, and means for producing an alarm signal when a transient non-deterministic event is detected.

8. A glass break detector as claimed in claim 7 wherein said high pass filter eliminates frequencies below about 1 kHz.

9. A glass break detector as claimed in claim 7 wherein said processing arrangement uses a statistical technique for determining whether the signal is non-deterministic.

10. A glass break detector as claimed in claim 9 wherein said processing arrangement uses autocorrelation like function to determine the amount of periodicity of the filtered signal and determining the filtered signal is non-deterministic when no significant periodicity is found.

11. A glass break detector as claimed in claim 10 wherein said processing arrangement further includes means for comparing the filtered signal with a reference signal representative of high frequency components of a predetermined glass break signal, said means for comparing using an approximate cross-correlation technique to evaluate, in combination with results of the autocorrelation, whether the filtered signal indicates that a glass break event has occurred.

12. A method of detecting the breaking of glass comprising sensing acoustical pressure and producing an electrical signal representative of the sensed acoustical pressure, and identifying changes in the signal caused by transient events and using statistical techniques for assessing the periodicity of the changes in the signal of a transient event and discriminating the changes in the signal caused by a transient event from background noise, determined by the normal signal, and producing an alarm signal when there is no significant periodicity in the portion of the signal containing the changes and the signal is of an intensity greater than background noise and distinguishable therefrom.

13. A method of detecting the breaking of glass as claimed in claim 12 including filtering the electrical signal to eliminate the effect of the low frequency "thud" associated with a glass break event.

14. A method of detecting the breaking of glass as claimed in claim 12 including initially passing the electrical signal through a high pass filter which filters out low frequency components of a glass break signal which commonly have significant periodicity.

15. A method of detecting the breaking of glass as claimed in claim 14 wherein said reference glass break signal has been processed to remove frequencies below 1 kHz.

16. A method of detecting the breaking of glass as claimed in claim 14 wherein the statistical techniques further include cross correlating the electrical signal with a predetermined reference glass break signal to determine the breaking of glass.

17. A method of detecting the breaking of glass as claimed in claim 16 including using autocorrelation techniques for determining whether the electrical signal is wide-band.

18. A method of detecting the breaking of glass as claimed in claim 17 including using a sample period for assessing the electrical signal less than the sample period necessary for an entire glass break event.

19. A glass break detector for detecting the shattering of glass during a glass break event, said glass break detector comprising an acoustic transducer which produces an electrical signal of the glass break event including initial low frequency components associated with a force leading to the flexure and subsequent shattering of the glass and high frequency components associated with the shattering of the glass which are wide-band with no significant periodicity and processing means for processing the electrical signal to remove low frequency components and analysing the remaining high frequency components of the signal for no significant periodicity and additional characteristics indicative of a possible glass shattering event and based thereon determining the occurrence of a glass break event.

20. A glass break detector for detecting the shattering of glass as claimed in claim 19 including statistical means for analysing the high frequency components of the electrical signal for no significant periodicity and for a wide-band signal.

21. A glass break detector for detecting the shattering of glass as claimed in claim 20 wherein said statistical means includes an autocorrelation technique for assessing wide-bandness of the electrical signal.

22. A glass break detector for detecting the shattering of glass as claimed in claim 20 wherein said statistical means uses a cross-correlation technique of the filtered signal relative a predetermined reference glass shattering signal for distinguishing a glass breakage event.

23. A glass break detector comprising a microphone which produces a wide-band frequency range electrical signal and a processing arrangement which filters the signal to provide high frequency components and to remove low frequency components, said processing arrangement analysing the filtered signal for recognition of a non-deterministic signal having a significant correlation relative to a predetermined reference glass break signal and producing an alarm when such a signal is recognized.

24. A glass break detector as claimed in claim 23 wherein said processing arrangement samples the filtered signal and uses statistical techniques for analysing the signal samples and determining whether a glass break event has occurred.

25. A glass break detector as claimed in claim 24 wherein said statistical techniques are autocorrelation and cross-correlation techniques.

* * * * *